US008801861B2

(12) United States Patent
Cobabe et al.

(10) Patent No.: US 8,801,861 B2
(45) Date of Patent: Aug. 12, 2014

(54) CLEANING APPARATUS WITH BRUSH HEAD DISENGAGER

(75) Inventors: Aaron D. Cobabe, Syarcuse, UT (US); W. Kenneth Thiess, Parker, CO (US); David Lowe, Parker, CO (US); David O. Meyers, Kaysville, UT (US)

(73) Assignee: Rubbermaid, Incorporated, Huntersville, NC (US)

( * ) Notice: Subject to any disclaimer, the term of this patent is extended or adjusted under 35 U.S.C. 154(b) by 132 days.

(21) Appl. No.: 13/499,819

(22) PCT Filed: Oct. 6, 2010

(86) PCT No.: PCT/US2010/051701

§ 371 (c)(1),
(2), (4) Date: Apr. 2, 2012

(87) PCT Pub. No.: WO2011/044291

PCT Pub. Date: Apr. 14, 2011

(65) Prior Publication Data

US 2012/0216831 A1 Aug. 30, 2012

Related U.S. Application Data

(60) Provisional application No. 61/249,250, filed on Oct. 6, 2009, provisional application No. 61/262,129, filed on Nov. 17, 2009.

(51) Int. Cl.

| | |
|---|---|
| ***B08B 1/04*** | (2006.01) |
| ***A46B 13/02*** | (2006.01) |
| ***B08B 1/00*** | (2006.01) |
| ***A46B 13/00*** | (2006.01) |

(52) U.S. Cl.

CPC ..... *B08B 1/002* (2013.01); *A46B 13/008* (2013.01); *A46B 13/02* (2013.01); *A46B 2200/3033* (2013.01)

USPC ..... 134/6; 15/28

(58) Field of Classification Search

CPC ..... B08B 1/002; A46B 13/02; A46B 13/008; A46B 2200/3033

USPC ..... 134/6; 15/28, 180

See application file for complete search history.

(56) References Cited

U.S. PATENT DOCUMENTS 3,171,994 A * 3/1965 Freedman et al. ..... 310/50
3,183,538 A 5/1965 Hubner (Continued)

OTHER PUBLICATIONS

Rubbermaid Incorporated et al., Canadian Application No. 2,776,915, Office Action, Sep. 18, 2013.

Rubbermaid Incorporated et al., International Patent Application No. PCT/US2010/051701, International Preliminary Report on Patentability/Written Opinion, Apr. 19, 2012.

(Continued)

*Primary Examiner* — Michael Barr
*Assistant Examiner* — Caitlin N Dunlap
(74) *Attorney, Agent, or Firm* — Dennis J. Williamson; Moore & Van Allen PLLC

(57) ABSTRACT

A cleaning apparatus includes an elongated housing bounding a chamber with a motor disposed therein. A drive shaft is at least partially disposed within the chamber of the housing, the drive shaft being coupled with the motor such that during selective operation of the motor the drive shaft is rotated. A hub having a rotational axis about which the hub rotates is coupled with the drive shaft such that rotation of the drive shaft facilitates rotation of the hub. A cleaning head is removably coupled with the hub such that rotation of the hub causes rotation of the cleaning head. A disengaging system is movable between a first position where the cleaning head is securely engaged to the hub and a second position where the cleaning head is freely removable from the hub.

18 Claims, 34 Drawing Sheets

(56) References Cited

U.S. PATENT DOCUMENTS

| | | | | |
|---|---|---|---|---|
| 3,289,231 | A | 12/1966 | Minton et al. | |
| 3,456,276 | A | 7/1969 | Spohr | |
| 4,335,480 | A | 6/1982 | Liu | |
| 2008/0222822 | A1 * | 9/2008 | Cobabe et al. | 15/28 |

OTHER PUBLICATIONS

Patent Cooperation Treaty, International Search Report, PCT/US2010/051701, May 23, 2011.

Patent Cooperation Treaty, Written Opinion, PCT/US2010/051701, May 23, 2011.

* cited by examiner

CLEANING APPARATUS WITH BRUSH HEAD DISENGAGER

CROSS-REFERENCE TO RELATED APPLICATIONS

This application is filed under the provisions of 35 U.S.C. §371 and claims the priority of International Patent Application No. PCT/US2010/051701 filed on 6 Oct. 2010 entitled "Cleaning Apparatus With Brush Head Disengager" in the name of Aaron D. COBABE, et al., which claims priority of U.S. Provisional Patent Application No. 61/262,129 filed on 17 Nov. 2009 and U.S. Provisional Patent Application No. 61/249,250 filed on 6 Oct. 2009, all of which are hereby incorporated by reference herein in their entirety.

BACKGROUND OF THE INVENTION

1. The Field of the Invention

The present invention relates to hand held cleaning apparatus having a reciprocating or rotating brush head.

2. The Relevant Technology

Household cleaning is a never ending business. Although there are numerous types of sponges and brushes that are specially designed to clean large, open surface areas such as countertops, sinks, and bathtubs, there are fewer resources available for cleaning the difficult cracks, corners, and other hard to reach areas that are ubiquitous in a home. Although conventional sponges and brushes can certainly be used for cleaning corners and other hard to reach areas, the configuration and large size of such conventional cleaners makes them difficult to access such areas. The user is often required to apply extensive force by the ends or tips of the fingers so as to force the cleaner into the crack or corner to be cleaned. Such cleaning is tiring and often results in cramping of the hand and/or fingers.

This problem is compounded by the fact that corners and cracks are typically where dirt, mold, soap scum, and other undesirables tend to grow or build-up. As such, extra energy or force is often necessary to clean such locations.

Conventional toothbrushes are often used to clean such hard to reach areas. The problem with toothbrushes, however, is that because they are specifically designed for cleaning teeth around sensitive gums, toothbrushes are typically too soft and do not have a good angle for any extended, aggressive scrubbing of hard surfaces. Furthermore, because of the small handles on toothbrushes, any significant scrubbing using a toothbrush again produces fatigue and cramping of the hand.

Toilet cleaning is another area in which improvements are desired. Typically a long-handled brush is used to clean the toilet. Then the brush is allowed to dry and stored until it is used again. This allows germs and other undesirable unsanitary matter to remain on the brush used to scrub the toilet. To remedy this, the brush can be discarded or sanitized after each cleaning. This helps in terms of sanitary conditions, but throwing away the toilet brush or sanitizing after each use can be very expensive. What would be nice is a cleaning apparatus having a disposable brush portion that can be removed and thrown away. Furthermore, doing so without having to touch the brush portion would also be desired.

Accordingly, what is needed are improved cleaning apparatuses that solve some or all of the above identified problems.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

The present invention relates to a cleaning apparatus having a reciprocating or rotating brush head. The cleaning apparatus is generally designed for domestic use in cleaning small, hard to reach areas such as cracks, corners, grooves and crevices. For example, the cleaning apparatus can be used for cleaning corners and around faucets on counter tops and in showers. It can also be used for spot scrubbing materials such as fabric and carpets. It is appreciated, however, that the apparatus can be used for cleaning any type of surface in commercial, residential, or any other application. The cleaning apparatus, however, is not designed for use as a toothbrush.

Figure 1:
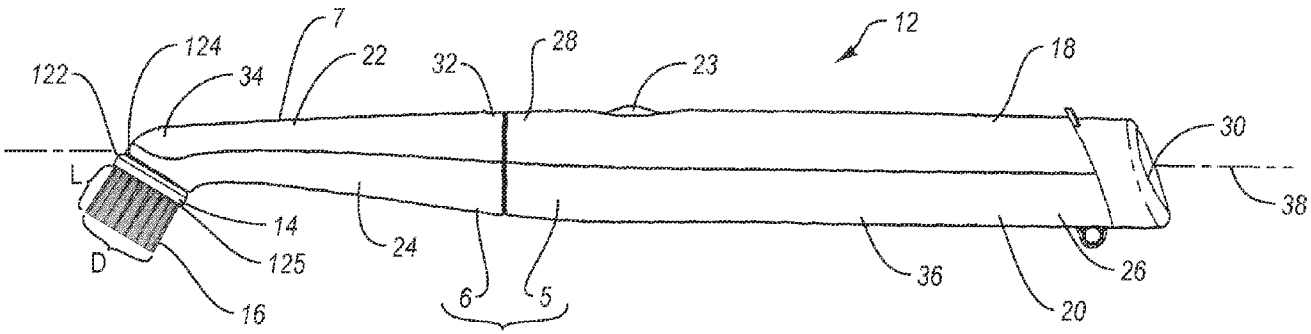
FIG. 1 is a an elevated side view of one embodiment of the inventive cleaning apparatus.
Figure 3:
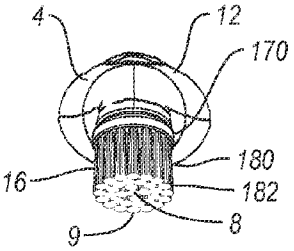
FIG. 3 is an elevated front end view of the cleaning apparatus shown in FIG. 1.
Figure 2:
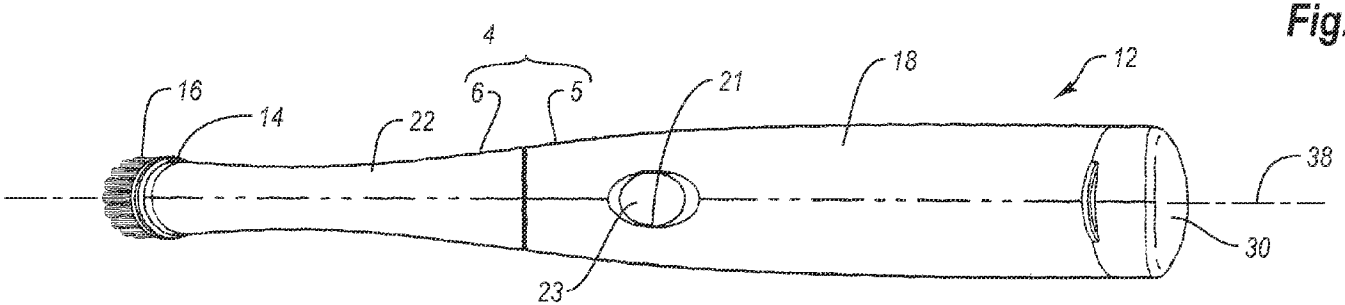
FIG. 2 is a top plan view of the cleaning apparatus shown in FIG. 1.

Depicted in FIGS. 1-3 is one embodiment of a cleaning apparatus 4 incorporating features of the present invention. Cleaning apparatus 4 generally comprises a body assembly 5 having a removable head assembly 6. Head assembly 6 includes a head housing 7 having an upper head housing 22 which mates with a lower head housing 24. Each of head housings 22 and 24 extend between a proximal end 32 and an opposing distal end 34.

Figure 4:
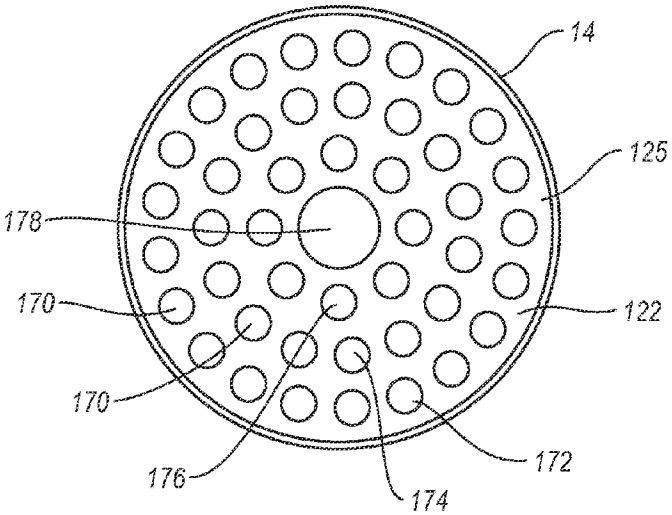
FIG. 4 is an elevated front view of the front face of the brush head shown in FIG. 3.

Head assembly 6 further includes a rotatable brush head 14 having a brush 16 mounted thereon. As will be discussed below in greater detail, brush head 14 comprises an annular carrier plate 122 having a top surface 124 and an opposing bottom surface 125. Depicted in FIG. 4, a plurality of tufting holes 170 are formed on bottom surface 125. In one embodiment tufting holes 170 are circular and each have a diameter in a range between about 1 mm to about 4 mm with about 2 mm to about 3 mm being more common. Tufting holes 170 are shown disposed in concentric rings. Alternatively, tufting holes 170 can also be randomly disposed or be in other patterns.

In the embodiment depicted, tufting holes 170 from an outer ring 172, a middle ring 174, an inner ring 176 and a center tufting hole 178. As seen in FIG. 3, disposed within each tufting hole 170 is a tuft 180 which is comprised of a plurality of bristles 182. The combined tufts 180 form brush 16. Bristles 182 can be made of a variety of different materials having different lengths and diameters. By adjusting the properties of the bristles 182, brush 16 can be formed having different stiffnesses to better suite different uses. In general, bristles having shorter length and increased diameter have increased stiffness.

Bristles 182 can be made from a variety of different natural or synthetic materials. In one embodiment, bristles 182 are comprised of a polymer material such as nylon. In other embodiments, such as for use in cleaning a barbeque grill, bristles 182 can be comprised of a metal such as brass, stainless steel, or copper. As depicted in FIG. 1, each bristle has an exposed length L which is typically in a range between about 0.3 cm to about 2.5 cm with about 1 cm to about 2 cm being more common. The depicted brush 16 has a substantially cylindrical configuration with a maximum diameter D that is typically in a range between about 1 cm to about 5 cm, with about 1 cm to about 3 cm being common, and about 1.5 cm to about 2.5 cm being more common. Larger brushes may have a diameter in a range from about 3 cm to about 5 cm. In alternative embodiments, brush 16 can have any desired configuration and can have any desired dimensions, including longer lengths and diameters, so as to function for a particular purpose.

Because head assembly 6 is removable from body assembly 5, it is appreciated that a variety of different head assemblies 6 can be made, each having a brush 16 of different configuration and/or properties. For example head assembly 6 can be formed each having a brush 16 with soft bristles, medium bristles, stiff bristles or combinations thereof. In one embodiment the soft bristles are comprised of a polymeric material having a diameter in a range between about 0.15 mm to about 0.25 mm with about 0.18 mm to about 0.23 mm being more common. Medium polymeric bristles typically have a diameter in a range between about 0.30 mm to about 0.48 mm with about 0.37 mm to about 0.42 mm being more common Finally, polymeric stiff bristles typically have a diameter in a range between about 0.48 mm to about 0.75 mm with about 0.52 mm to about 0.58 mm being more common. By way of comparison, bristles on tooth brushes typically have a diameter less than 0.15 mm so that the bristles are not so stiff as to damage the gums or enamel of the teeth.

In one embodiment having a combination of bristles 182, tufting holes 170 in outer ring 172, middle ring 174, and inner ring 176 (FIG. 4) are filled with medium bristles while center tufting hole 178 is filled with stiff bristles forming a stopping tuft. The bristles in the stopping tuft are shorter than the other bristles. During use, the stiffness of the stopping tuft helps limit the collapse of the other tufts as the brush is pressed against the surface to be cleaned. This helps to ensure that the tips of the bristles, as opposed to the sides, are primarily used for scrubbing. Bristles having different properties can also be defined by relative percentages. For example, in a brush having a stopping tuft and cleaning tufts, the bristles of the cleaning tufts can have a length that is at least 20% longer or at least 30% longer than the bristles of the stopping tuft and a diameter that is at least 30% smaller or at least 40% smaller than the bristles of the stopping tuft.

Similarly, in one embodiment depicted in FIG. 3, brush 16 can comprise a group of central tufts 8 which are surrounded by outer perimeter tufts 9. The outer perimeter tufts 9 are slightly longer and softer than central tufts 8. As such, light contact by brush 16 produces soft scrubbing by outer perimeter tufts 9 while harder biasing of brush 16 causes central tufts 8 to engage the surface, thereby producing harder scrubbing. In alternative embodiments, all the tufts/bristles can be the same length, diameter, or stiffness or any combination of lengths, diameters and stiffness can be used.

Body assembly 5 includes a body housing 12 having a substantially cylindrical configuration. Body housing 12 can have a circular, elliptical or any other desired transverse cross section and is sized to comfortably fit within the hand of a user. In one embodiment, body housing 12 has a maximum diameter in a range between about 2.5 cm to about 4.5 cm. Other dimensions can also be used. Body housing 12 comprises an upper body housing 18 which mates with a lower body housing 20. Each of body housings 18 and 20 also extend from a proximal end 26 to an opposing distal end 28. Upper body housing 18 has an aperture 21 in which a flexible button 23 is mounted (see FIG. 5). Removably mounted to proximal end 26 of body housing 12 is an end cap 30. It is noted that button 23 is positioned on one side of cleaning apparatus 4 while brush 16 projects from the other side of cleaning apparatus 4. This configuration enables the user to easily activate button 23 during using of cleaning apparatus 4. Furthermore, by having this configuration, the force used to press down on button 23, such as with the thumb of the user, can also be used for pressing the brush against the surface to be cleaned.

Head housing 7, body housing 12, and end cap 30 combine to form a housing 36. Housing 36 has a substantially cylindrical configuration with a length extending between proximal end 32 and end cap 30 that is typically in a range between about 15 cm to about 35 cm with about 20 cm to about 30 cm being more common. Other dimensions can also be used. In alternative embodiments housing 36 can have a variety of other configurations. Although housing 36 may not be completely symmetrical along its entire length, housing 36 has a substantially central longitudinal axis 38 extending therethrough.

Figure 5:
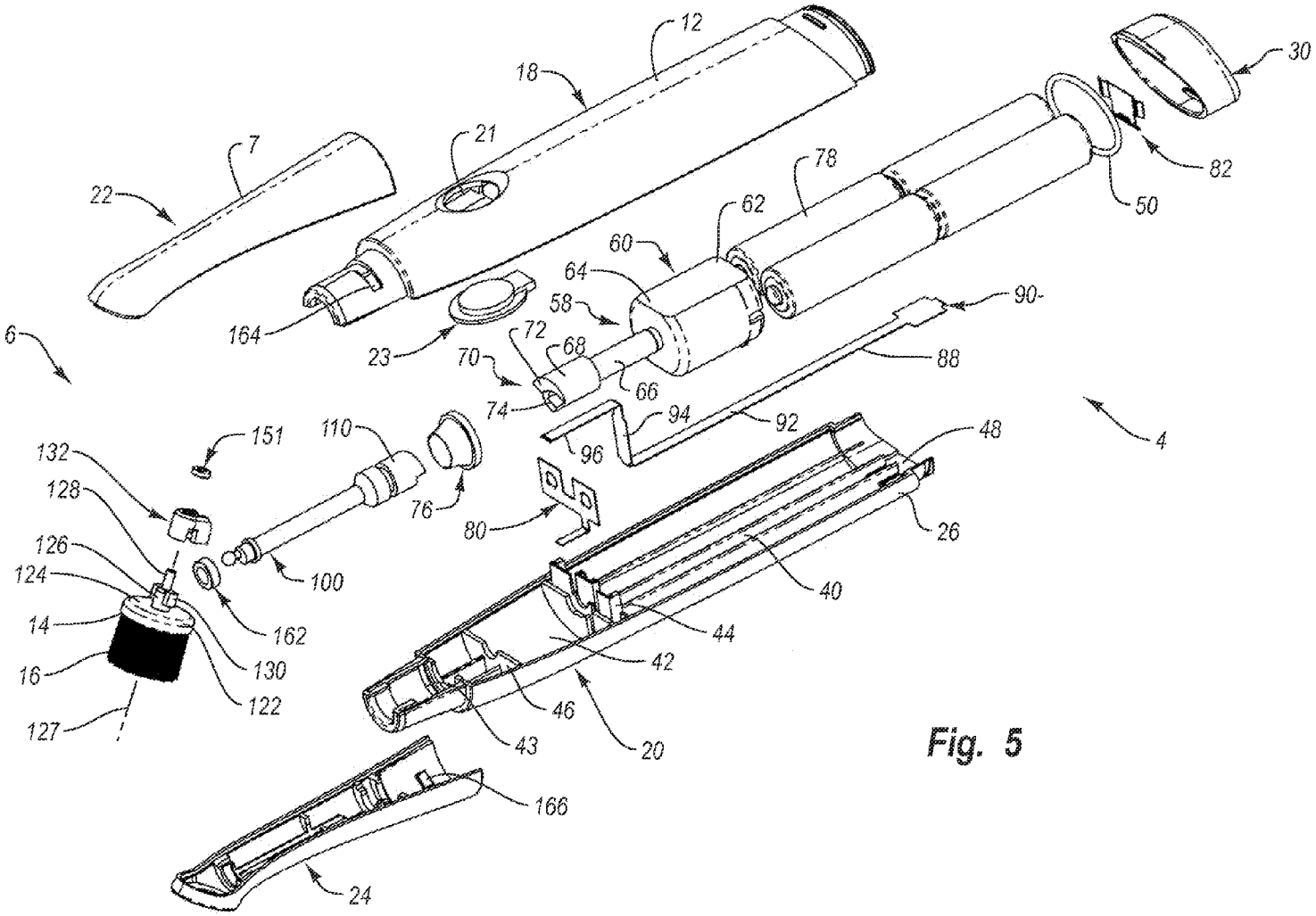
FIG. 5 is an exploded view of the cleaning apparatus shown in FIG. 1.

As depicted in FIG. 5, body housing 12 bounds a battery compartment 40, a motor compartment 42, and a shaft compartment 43. A partition 44 is formed between compartment 40 and 42 while a partition 46 is formed between compartment 42 and 43. Battery compartment 40 is accessed through an opening 48 formed at proximal end 26 of body housing 12. Opening 48 is selectively closed by end cap 30. An annular seal ring 50 forms a liquid tight seal between body housing 12 and end cap 30.

Figure 6:
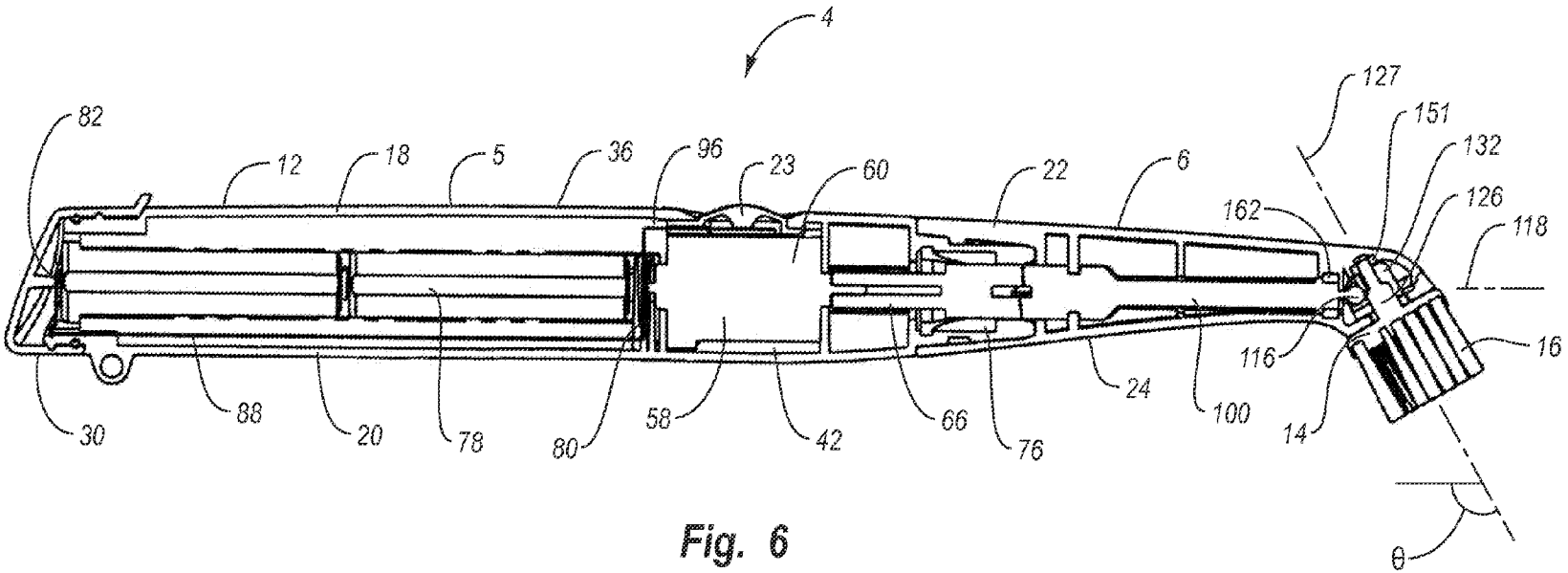
FIG. 6 is a cross sectional side view of the cleaning apparatus shown in FIG. 1.

As depicted in FIGS. 5 and 6, cleaning apparatus 10 further includes a motor assembly 58. Motor assembly 58 comprises a motor 60 having a proximal end 62 and an opposing distal end 64 that is mounted within motor compartment 42. Projecting from distal end 64 of motor 60 into shaft compartment 43 is a drive shaft 66 terminating at a first coupling 68. First coupling 68 terminates at an end face 70. End face 70 comprises a pair of sloping surfaces 72 that are connected by stepped shoulders 74. An annular shaft seal 76 encircles first coupling 68 and forms a liquid tight seal between first coupling 68 and body housing 12.

Battery compartment 40 is configured to receive a plurality of batteries. For example, in the embodiment battery compartment 40 is configured to receive four batteries 78 of a size AA. Other sizes and numbers of batteries can also be used in alternative embodiments. The positive end of batteries 78 bias against a first contact plate 80 which is in electrical communication with motor 60. The negative end of batteries 78 bias against a second contact plate 82 which is mounted within end cap 30.

An elongated switch 88 has a first end 90 which is in electrical communication with second contact plate 82 when end cap 30 is mounted to body housing 12. Switch 88 comprises an elongated base 92 which extends along battery compartment 40, a riser 94 which extends along partition 44, and a flexible lever arm 96 which projects so as to be disposed between button 23 and motor 60. When button 23 is manually depressed, lever 96 is biased against motor 60, thereby closing the circuit which is energized by batteries 78. In turn, as the circuit is closed, the energy from batteries 78 causes motor 60 to rotatably drive shaft 66. As button 23 is released, the circuit is broken and motor 60 is turned off. In alternative embodiments, it is appreciated that a variety of different switching mechanisms can be used so that motor 60 can be continually activated without having to continually manually depress button 23. Furthermore, it is appreciated that batteries 78 can be replaced with an electrical cord to power the motor. Using an electrical cord, an A/C motor can alternatively be used.

With further reference to FIGS. 5 and 6, head assembly 6 further comprises a drive shaft 100. As depicted in FIG. 8, drive shaft 100 comprises an elongated shaft 102 having a proximal end 104 and an opposing distal end 106. Distal end 106 terminates at a distal end face 108. Radially encircling and outwardly projecting from shaft 102 at distal end 106 is an annular flange 109. A bearing or bushing 162 (FIG. 7) is mounted on shaft 102 so as to bias against flange 109. Mounted at proximal end 104 of shaft 102 is a second coupling 110 having an end face 112 that is complementary to end face 70 of first coupling 68. That is, second coupling 110 is configured to mesh with first coupling 68 so that stepped shoulders 74 bias against one another. As a result, rotation of drive shaft 66 by motor 60 is transferred through couplings 68 and 110 to cause rotation of shaft 102.

Extending from end face 108 at distal end 107 of shaft 102 is a stem 114. Mounted on the end of stem 114 is a rounded head 116. In the embodiment depicted, head 116 is spherical or substantially spherical. Here it is noted, as will be discussed below in greater detail, shaft 102 has a rotational axis and central longitudinal axis 118, which in the depicted embodiment are the same, and stem 114 has a central longitudinal axis 120. Stem 114 is eccentrically mounted on end face 108 of shaft 102 so that central longitudinal axis 120 of stem 114 is offset from central longitudinal axis 118 of shaft 102. Rotational axis 118 can also be the same axis as the rotational axis and central longitudinal axis of drive shaft 66 and can also be the same as central longitudinal axis 38 of housing 36 (FIG. 1).

Returning to FIG. 5, brush head 14 comprises annular carrier plate 122, as previously discussed, having top surface 124. Projecting from top surface 124 is a spindle 126. Spindle 126 comprises a central axle 128 having an arm 130 projecting from each side thereof. A rotational axis 127, about which brush 16 and brush head 14 rotate, extends through spindle 126. Rotational axis 127 can also be the central axis for brush 16 and brush head 14. Mounted on spindle 126 is a hub 132. As depicted in FIG. 9A, hub 132 has opposing side surfaces 136 and 138 which extend between a top surface 140 and an opposing bottom surface 142. Hub 132 also includes a front face 144 and an opposing back face 146. A passage 148 extends from top surface 140 to bottom surface 142. A side channel 150 extends through side surfaces 136 and 138 adjacent to bottom surface 142 so as to intersect with passage 148.

During assembly, hub 132 is received over spindle 126 so that axle 128 extends through passage 148 and arms 130 are received within side channel 150. A bearing or bushing 151 (FIG. 5) is mounted on axle 128 at top surface 140 of hub 132. In this configuration, hub 132 is engaged with spindle 126 such that rotation of hub 132 facilitates rotation of spindle 126 and thus the remainder of brush head 14. In alternative embodiment, it is appreciated that hub 132 can be integrally formed with brush head 14.

Hub 132 further comprises a channel 152 formed on front face 144 and extending to top surface 140. Channel 152 is vertically aligned with passage 148 and is bounded by a first engagement surface 156, a spaced apart second engagement surface 158, and an inside face 159 extending therebetween. Engagement surfaces 156 and 158 are opposingly facing and are in substantially parallel alignment. Recessed along each engagement surface 156 and 158 is a locking channel 160. Each locking channel 160 is elongated and is slightly arched along the length thereof. The distance between engagement surfaces 156 and 158 of hub 132 is smaller than the diameter of rounded head 116.

Figure 7:
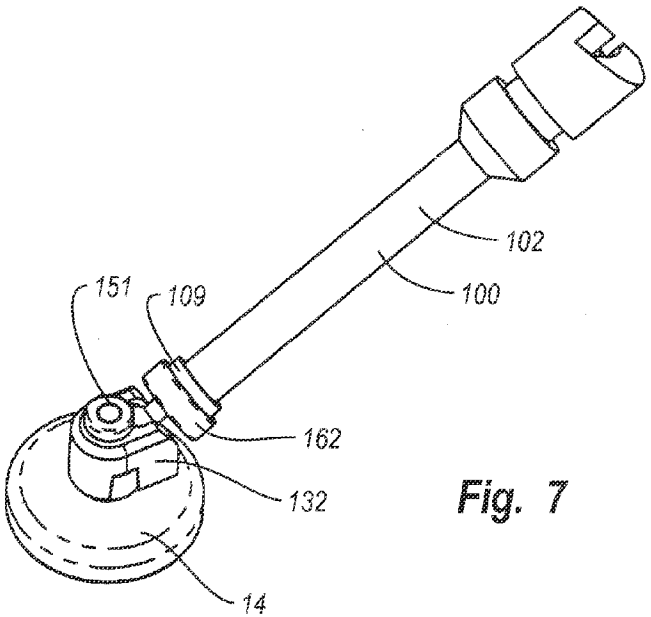
FIG. 7 is a perspective view of a subassembly of the cleaning apparatus shown in FIG. 1 showing a drive shaft coupled with a hub and brush head.
Figure 8:
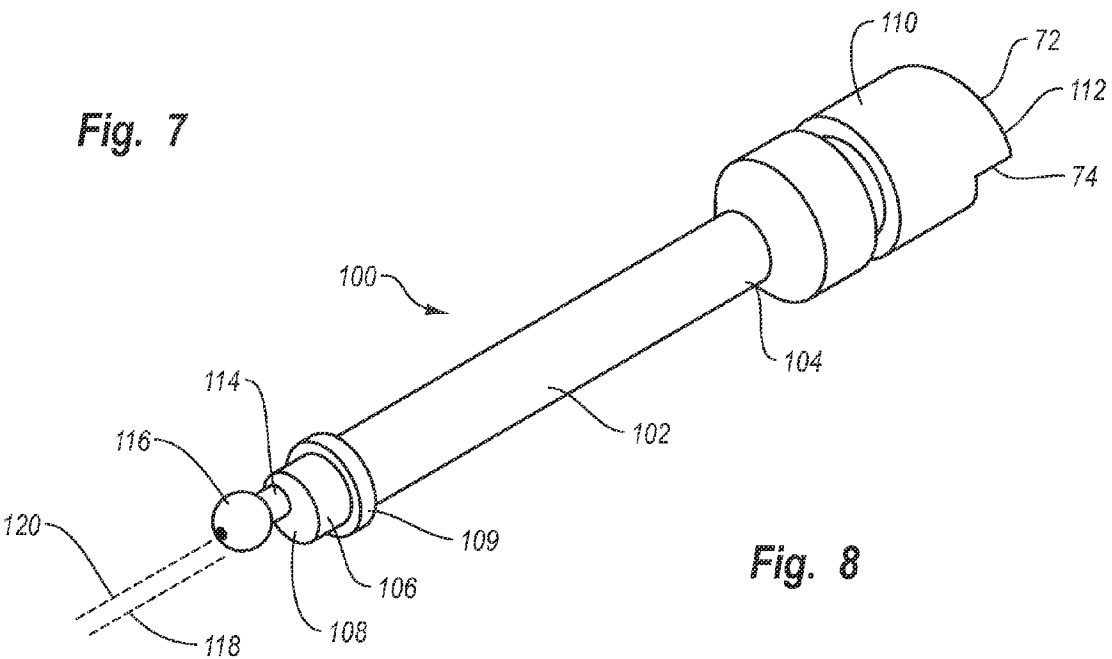
FIG. 8 is an enlarged perspective view of the drive shaft shown in FIG. 7.
Figure 10:
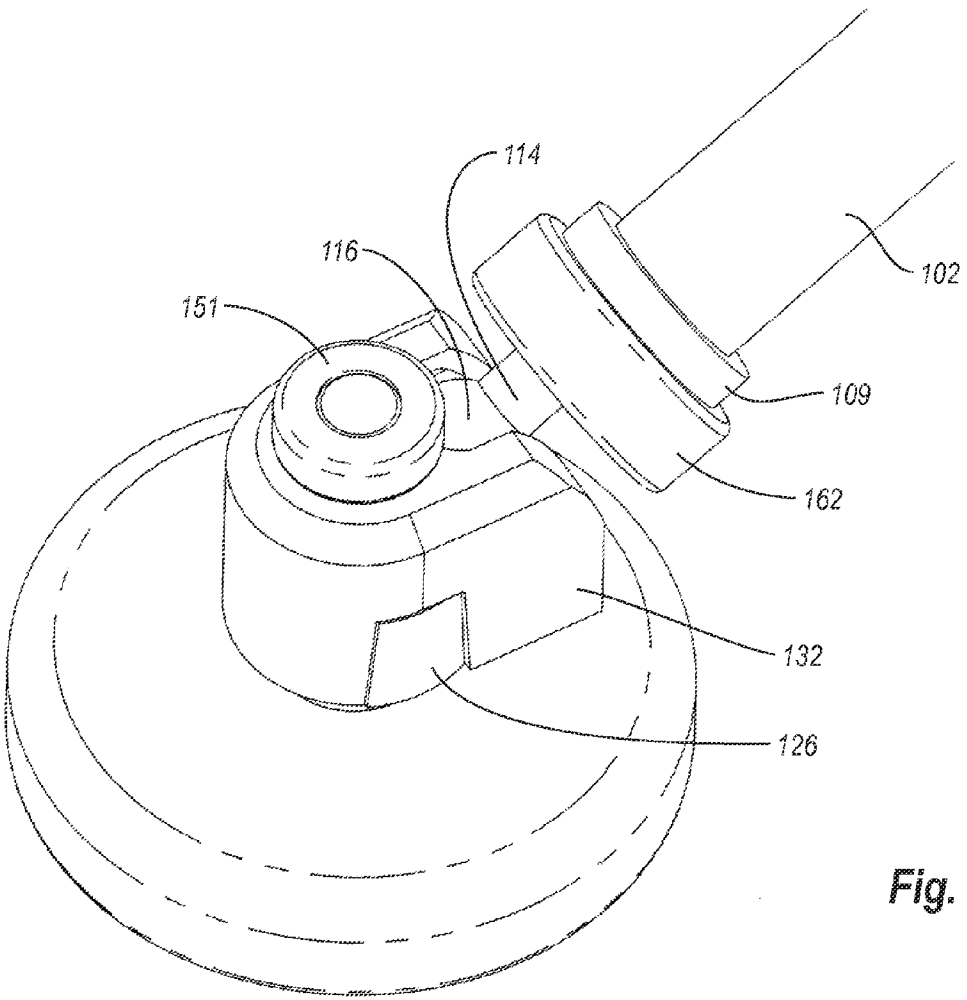
FIG. 10 is an enlarged perspective view of the coupled parts shown in FIG. 7.

As depicted in FIGS. 7 and 10, however, hub 132 is configured so that head 116 can be snap-fit between engagement surfaces 156 and 158 so that head 116 is resiliently captured within locking channels 160 formed on engagement surfaces 156 and 158. In this configuration, head 116 is resiliently biased between faces 156 and 158.

Figure 9B:
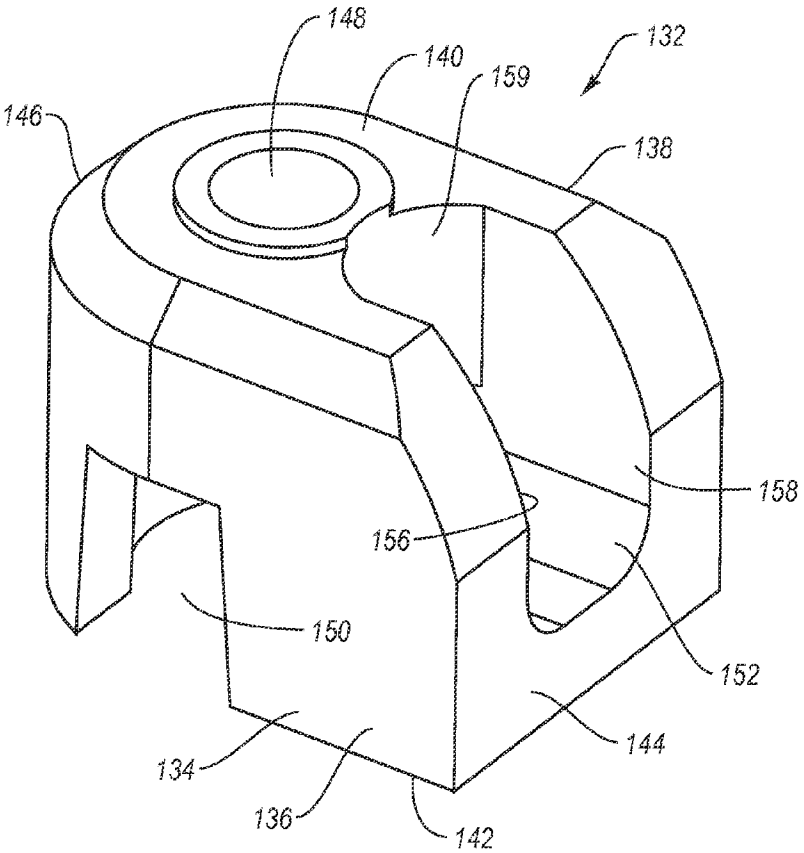
FIG. 9B is an enlarged perspective view of an alternative embodiment of the hub shown in FIG. 9A.
Figure 9A:
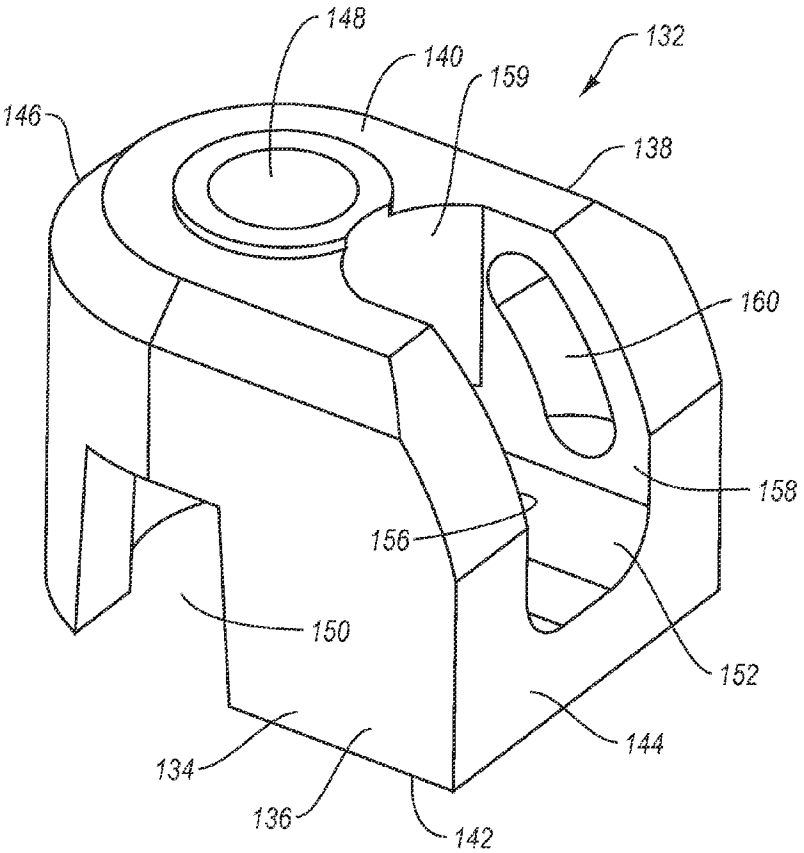
FIG. 9A is an enlarged perspective view of the hub shown in FIG. 7.

In an alternative embodiment depicted in FIG. 9B, locking channels 160 can be eliminated so that engagement surfaces 156 and 158 are substantially flat. In this embodiment, head 116 can be sized to snugly or loosely fit between engagement surfaces 156 and 158.

Returning to FIG. 5, head housing 7 is enclosed over drive shaft 100 and hub 132 so that head housing 7 rides against bearings 151 and 162. Bayonet slots 164 are formed on distal end 28 of body housing 12 while bayonet prongs 166 project from proximal end 32 of head housing 7. As such, head assembly 6 can be removably connected to body assembly 5 using the bayonet connection (FIG. 1).

In the above assembled configuration, couplings 68 and 110 are mated. Accordingly, as button 23 is depressed, motor 60 is energized causing drive shaft 66 and drive shaft 100 to each rotate about their rotational or central longitudinal axis. In turn, because stem 114 and rounded head 116 are mounted eccentrically on shaft 102, head 116 rotates in a circle. That is, as shaft 102 spins or rotates, head 116 begins to rotate in an enlarged circle so as to bias against engagement surface 158 of hub 132 causing hub 132 with connected brush head 14 and brush 16 to rotate in a first direction about axle 128. The length and arch of locking channels 160 allows for free rotation of head 116 within locking channels 160.

Once head 116 has moved to its furthest extent in one direction, head 116 then begins to bias against the opposing engagement surface 156 causing hub 132, with connected brush head 14 and brush 16, to rotate in the opposing direction about axle 128. As such, rapid rotation of drive shaft 100 with head 116 causes hub 132 with connected brush head 14 and brush 16 to rapidly reciprocate. By securing head 116 within locking channels 160, a snug engagement can be formed between hub 132 and head 116. This snug fit optimizes the transfer of movement between drive rod 100 and hub 132. That is, the snug fit eliminates slop between hub 132 and drive rod 100 even after head 116 has begun to wear within locking channels 160.

Once cleaning apparatus 10 is energized, brush 16 can be biased against a surface for cleaning. It is noted that brush 16 is positioned at an orientation relative housing 36 so as to optimize convenience and use. For example, with reference to FIG. 6, in one embodiment brush 16 projects relative to the central longitudinal axis of body assembly 5 or head assembly 6 so as to form a set inside angle θ therewith that is typically greater than 95° and commonly in a range between about 90° to about 180° with about 110° to about 140° being more common. Other angles can also be used. Expressed in other terms, rotational axis 127 of brush head 14 or brush 16 intersects with rotational axis 38 of the drive shaft or of central longitudinal axis 118 of housing 36 so as to form the set inside angle θ as discussed above. By having the angle θ at about 110° to about 140°, the user is able to more conveniently place and use brush 16 while holding onto housing 36.

The present invention may be embodied in other specific forms without departing from its spirit or essential characteristics. The described embodiments are to be considered in all respects only as illustrative and not restrictive. For example, it is appreciated that locking channels 160 need not merely be recessed within inner side walls 156 and 158 but can completely extend through hub 132. Furthermore, it is not necessary that head 116 be spherical. In alternative embodiments, it is appreciated that head 116 can be elliptical or have a variety of other configurations that mate with complementary locking channels.

Figure 11:
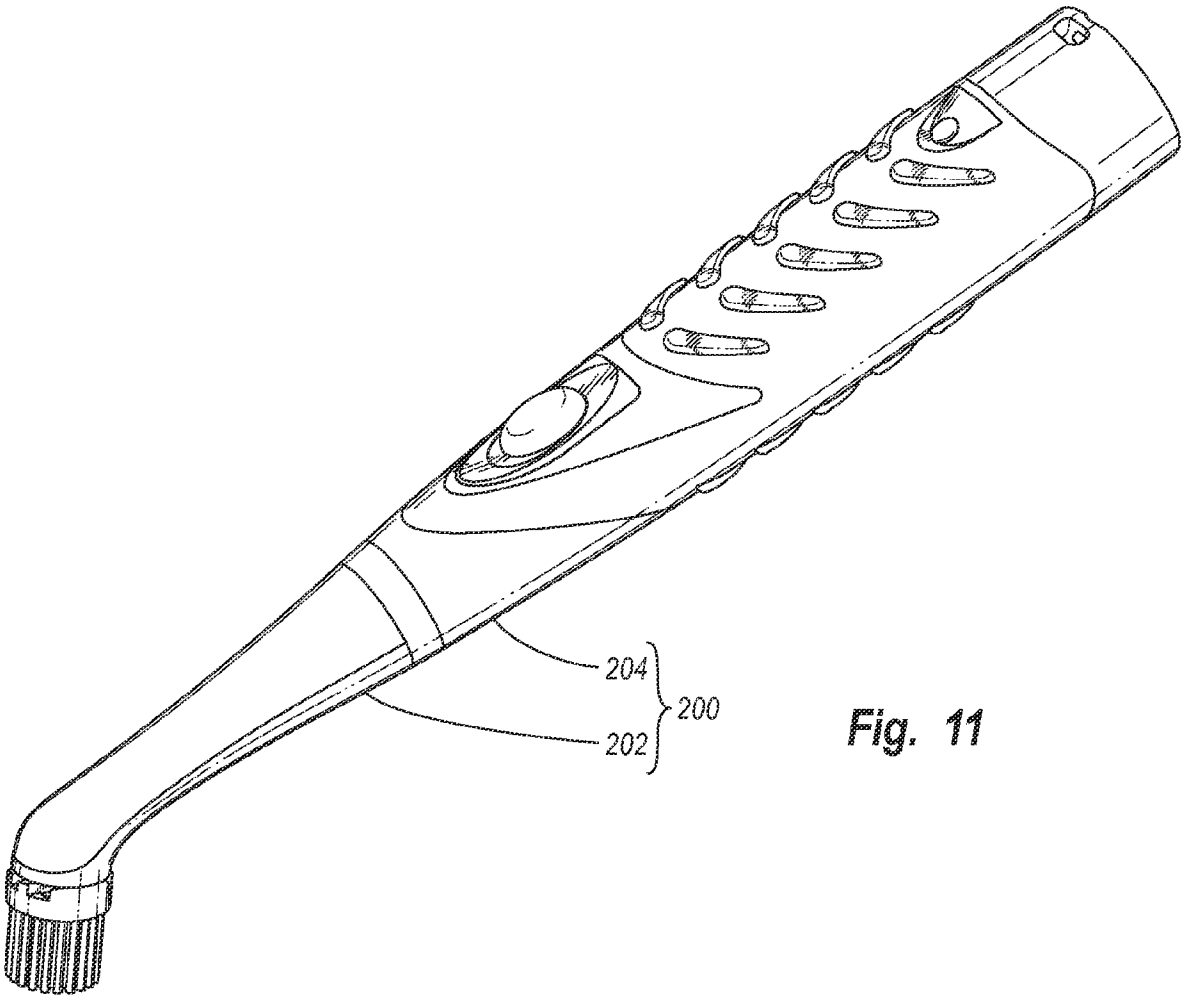
FIG. 11 is a perspective view of an alternative embodiment of a cleaning apparatus.
Figure 12A:
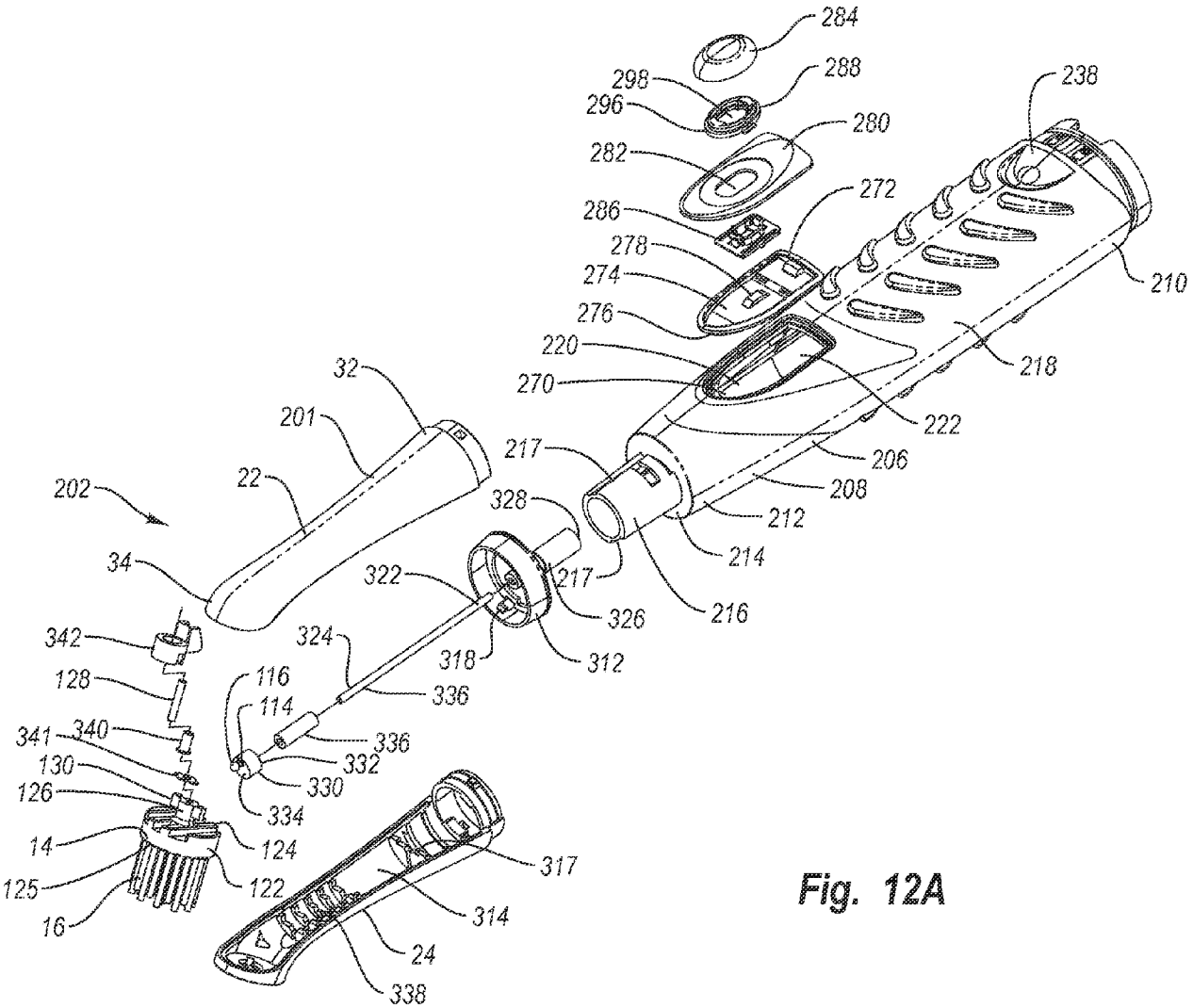
FIGS. 12A and 12B are exploded views of the cleaning apparatus shown in FIG. 11.

Depicted in FIG. 11 is an alternative embodiment of a cleaning apparatus 200 incorporating features of the present invention. Like elements between cleaning apparatus 10 and 200 are identified by like reference characters. Cleaning apparatus 200 comprises a head assembly 202 and a body assembly 204. Turning to FIG. 12A, body assembly 204 comprises a body housing 206 which is molded as a tubular member. Body housing 206 comprises a handle portion 208 having a proximal end 210 and an opposing distal end 212. Distal end 212 terminates at and end face 214 from which a tapered, tubular stem 216 projects. A pair of opposing bayonet slots 217 are formed along stem 216. Handle portion 208 and stem 216 are typically comprised of a substantially rigid plastic such as ABS. An overlay 218, comprised of a softer, flexible plastic such as TPE or rubber, is molded over a section of handle portion 208. Overlay 218 allows improved gripping of cleaning apparatus 200.

Figure 12B:
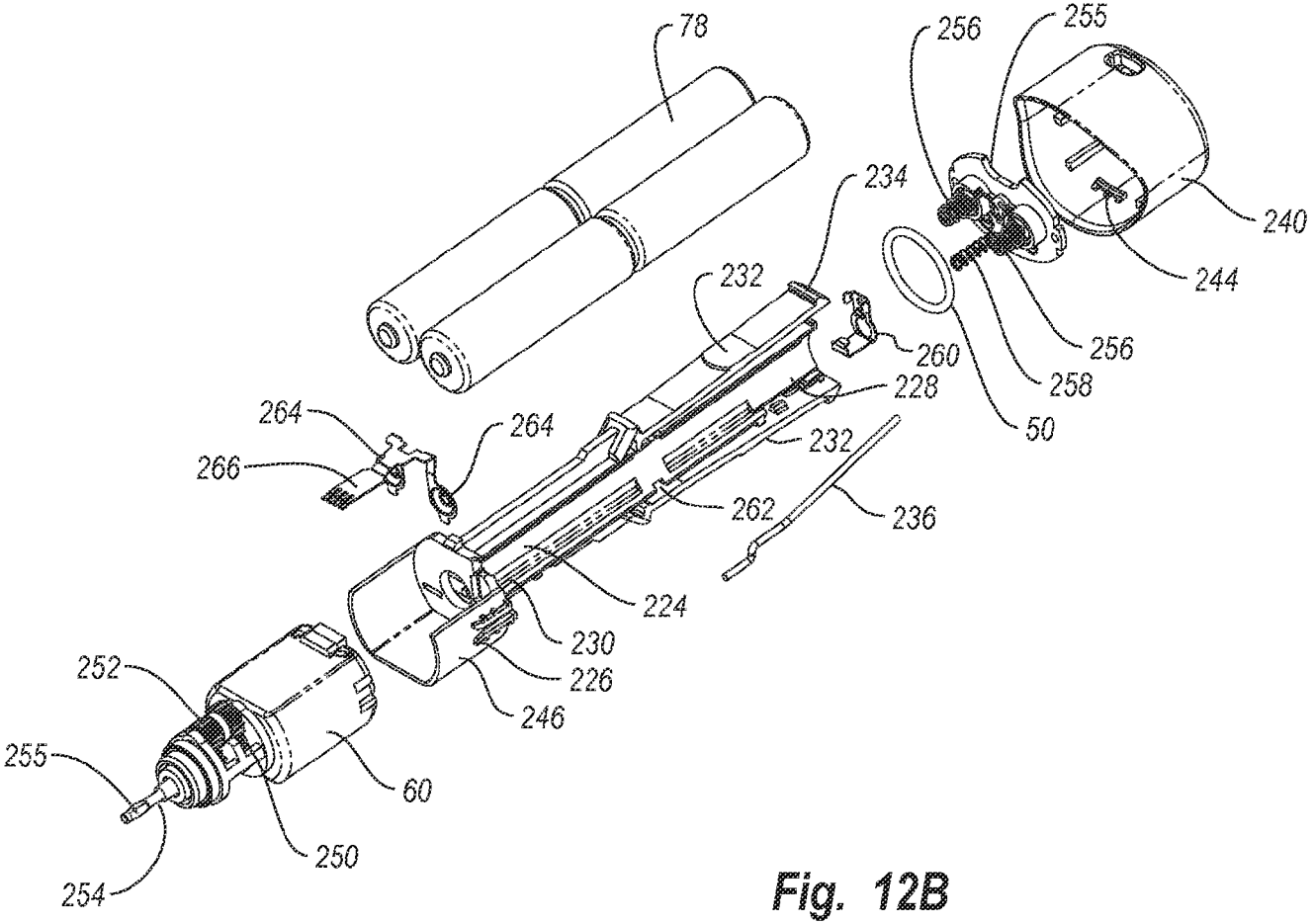
Figure 13:
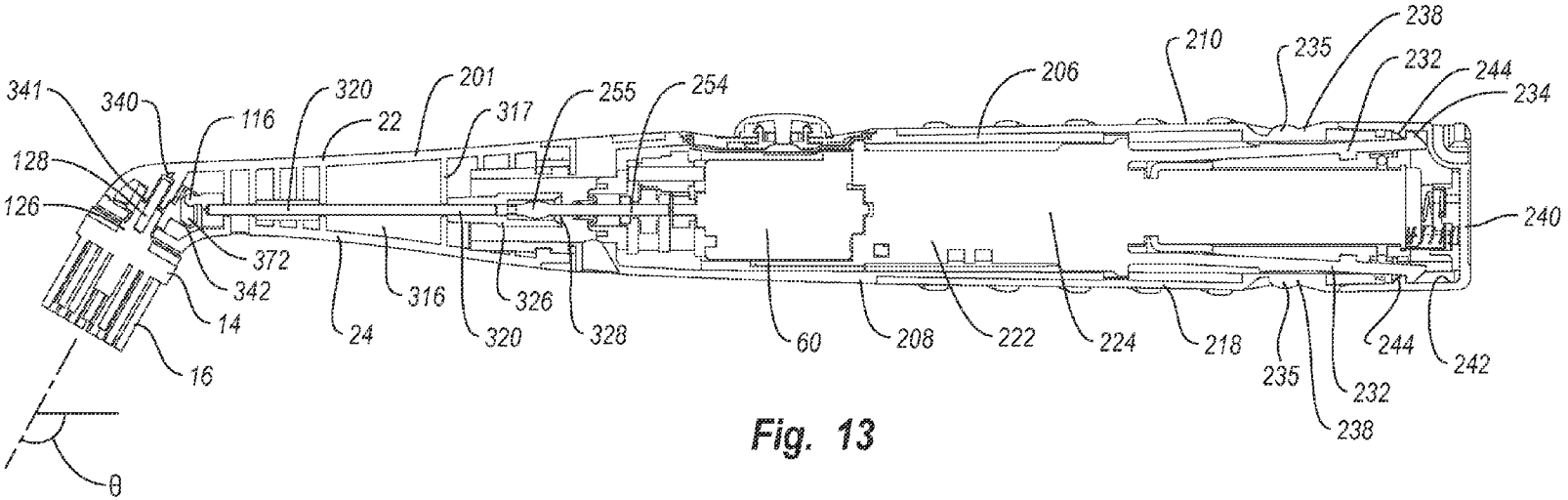
FIG. 13 is a cross sectional side view of the cleaning apparatus shown in FIG. 11.

Body housing 206 has an interior surface 220 which bounds a chamber 222. Turning to FIG. 12B, secured within chamber 222 is a guide 224. Guide 224 comprises an elongated partition wall 226 having a proximal end 228 and an opposing distal end 230. The sides of partition wall 228 are curved so that batteries 78 can be complementarily received on each side thereof. A cantilevered latch 232 is formed at proximal end 238 at both the top and bottom of partition wall 226. Each latch 232 terminates at a barb 234. A spring 236 is positioned between partition wall 226 and each latch 232 so that each latch 232 can be selectively compressed toward partition wall 226 and, when released, each latch 232 resiliently rebounds. As depicted in FIG. 13, holes 235 are formed through each side of handle portion 208 at proximal end 210. An engaging portion 238 of overlay 218 is molded over holes 235. Guide 224 is positioned within chamber 222 to that each latch 232 is aligned with a corresponding hole 235. A user is thus able to manually press inward on the flexible engaging portions 238 of overlay 218 so as to selectively inwardly press latches 232.

Latches 232 are used for securing an end cap 240 to proximal end 210 of body housing 206. Specifically, end cap 210 has an interior surface 242 with a pair of opposing catches 244 formed thereon. When end cap 240 is pushed onto proximal end 210 of body housing 206, barbs 234 on latches 232 engage catches 244 so as to securely lock end cap 240 on body housing 206. To remove end cap 240, engaging portions 238 are manually depressed as discussed above so as to inwardly flex latches 232 and thus release barbs 234 from catches 244.

Returning to FIG. 12B, cupped support 246 is formed at distal end 230 of partition wall 226 and is used to support motor 60. Motor 60 rotates an initial shaft 250 which in turn rotates a drive shaft 254. Drive shaft 254 has a head 255 formed at a distal end thereof. Head 255 typically has a non-circular transverse cross section such that it can engage with a coupler as discussed below in greater detail. In the embodiment depicted, head 255 comprises a flattened portion of drive shaft 254. In alternative embodiments, head 255 can have any number of different polygonal or non-circular transverse cross sections.

A conventional gear assembly 252 extends between initial shaft 250 and drive shaft 254 so that the torque produced by drive shaft 254 is adjusted relative to the torque produced by initial shaft 250 by a ratio in a range between about 1.5:1 to about 3.5:1. Increasing the torque capacity of drive shaft 254 enable brush 16 to continue to reciprocate or rotate even when substantial bearing force is applied to brush 16 while scrubbing. This is contrary to many conventional electric toothbrushes where it is desired that the brush stop moving or significantly slow when too much force is applied so that the toothbrush does not damage the gums.

It is appreciated that there are a variety of different mechanism that can be used to transfer electricity from batteries 78 to motor 60. In the illustrated embodiment, the four batteries 78 are disposed in parallel. The negative end of the back two batteries 78 bias against a corresponding spring 256 which are each in electrical communication with a transfer spring 258. The springs are mounted on a plate 255 which is secured within end cap 240. Transfer spring 258 biases against a contact 260. An electrical lead 262 extends from contact 260 to motor 60. The positive end of the front two batteries 78 bias against a correspond contact 264 which are each in electrical communication with a flexible switch 266. Switch 266 is positioned above motor 60 such that when switch 266 is biased against motor 60, the circuit is complete and motor 60 is energized.

In an alternative embodiment, batteries 78 can be positioned in series rather then parallel. In this embodiment, springs 256 are in electrical communication with each other but transfer spring 256, contact 260, and lead 262 are eliminated. Likewise, the two contacts 264 are separated from each other. One of contacts 264 is in direct electrical communication with motor 60 while the other contact 264 remains connected with switch 266. Placing batteries 78 in series increases the voltage to provide more power to the motor. Of course, batteries 78 can be rechargeable, if desired, and an on-board charger can be used.

Returning to FIG. 12A, an opening 270 is formed on a top surface of body housing 206 so as to communicate with chamber 222. Opening 270 is aligned with motor 60 and switch 266. Secured within opening 270 is a flexible diaphragm 272. Diaphragm 272 has a top surface 274 and an opposing bottom surface 276. A projection 278 is formed on top surface 274. A cover plate 280 has an elongated hole 282 extending therethrough and is secured over opening 270 so that hole 282 is aligned with projection 278. A button 284 is slidably mounted to cover plate 280 by a catch 286 and a retainer 288.

Figure 14C:
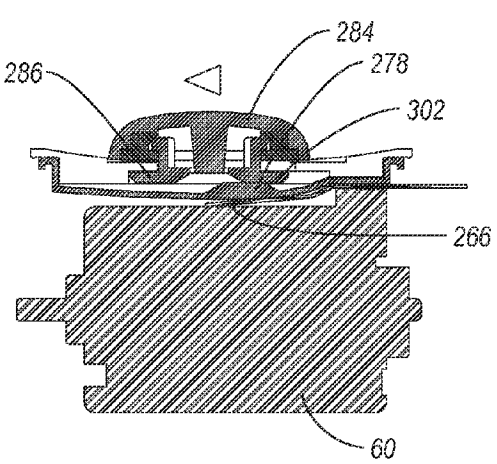
FIG. 14C is an enlarged cross sectional side view of the button switch assembly shown in FIG. 14A in an on position.
Figure 14B:
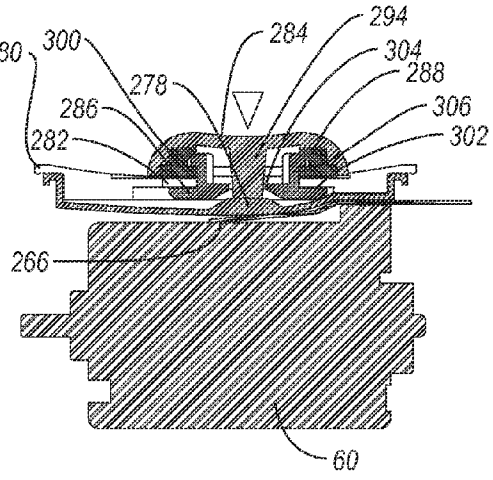
FIG. 14B is an enlarged cross sectional side view of the button switch assembly shown in FIG. 14A in a momentary position.
Figure 14A:
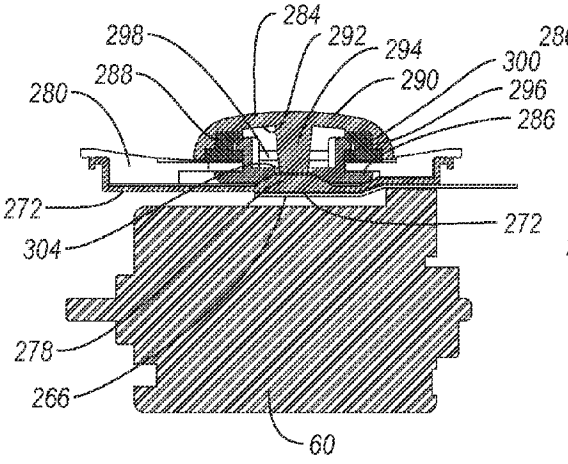
FIG. 14A is an enlarged cross sectional side view of the button switch assembly shown in FIG. 13 in an off position.

As depicted in FIG. 14A, button 284 comprises a generally cup-shaped body 290 having an interior surface 292 with a stem 294 projecting therefrom. Button 284 is comprised of a resiliently flexible material which is typically a natural or synthetic rubber. Retainer 288 comprises a substantially circular frame 296 having an opening 298 extending therethrough. Opening 298 is at least partially bounded by a lip 300. Retainer 288 is comprised of a substantially rigid material or at least a material that is more rigid than the material used for button 284. Button 284 is secured to retainer 288 so that stem 294 passes through opening 298. In one embodiment, button 284 is secured to retainer 288 by being molded directly onto retainer 288 during the formation of button 284, i.e., overlay molding process.

Catch 286 (FIG. 14B) comprises a base 302 having an opening 304 extending therethrough. A pair of barbed prongs 306 upwardly project from a top surface of base 302 on opposing sides of opening 304. Catch 286 is used to secure button 284 on cover plate 280. Specifically, button 284 and retainer 288 are positioned on the top surface of cover plate 280 so that stem 294 is aligned with opening 282 of cover plate 280. Prongs 306 of catch 286 are then pushed up through opening 282 of cover plate 280 from the bottom surface thereof so that prongs engage with lip 300 of retainer 288 by a snap fit connection.

In this assembled configuration, button 284 can selectively side on cover plate 280 between an off position as shown in FIG. 14A and an on position as shown in FIG. 14C. In the off position, projection 278 of diaphragm 272 is disposed between stem 294 of button 284 and switch 266 and is at least partially disposed within opening 304 of catch 286. In this position, switch 266 is spaced apart from motor 60 so that no electrical contact is made. From the off position, there are two ways in which a user can energize motor 60. In one approach, as depicted in FIG. 14B, a user can simply press down on the center of button 284. In so doing, stem 294 is pressed down against projection 278 which in turn pushes down switch 266 so that switch 266 contacts motor 60, thereby energizing motor 60. When the user releases button 284, button 284 resiliently returns to the off position.

In the second approach as depicted in FIG. 14C, the user manually slides button 284 along cover plate 280. In so doing, base 302 of catch 286 rides over projection 278 which pushes projection 278 downward again causing switch 266 to contact motor 60, thereby energizing motor 60. Motor 60 remains energized until button 284 is again moved back to the off position. The button assembly thus enables a single, integral button to activate the motor in two different modes of operation.

Returning to FIG. 12A, head assembly 202 comprises a head housing 201 which includes an upper head housing 22 and a lower head housing 24 each having a proximal end 32 and an opposing distal end 34. Head housing 201 bounds a channel 314 extending along the length thereof which is at least partially divided by complementary partition walls 317 formed on housing 22 and 24. Secured between housing 22 and 24 at proximal end 32 is an engagement ring 312. Engagement ring 312 has an opposing bayonet prong 318 formed on an interior surface thereof. Head assembly 202 is removably secured to body assembly 204 by inserting stem 216 of body housing 206 within proximal end 32 of head assembly 202 so that bayonet prongs 318 are received within bayonet slots 217 and then rotating head assembly 202 relative to body assembly 204.

Head assembly 202 comprises a drive shaft 320 having a proximal end 322 and an opposing distal end 324. Proximal end 322 has a coupler 326 secured thereto. Coupler 326 has a socket 328 formed on the free end thereof that is designed to removably engage with head 255 on drive shaft 254 extending from motor 60. Specifically, socket 328 has a configuration complementary to head 255 such that when head 255 is received within socket 328, rotation of drive shaft 254 causes rotation of drive shaft 320. Head 255 is removably received within socket 328 when head assembly 202 is removably coupled with body assembly 204 as discussed above.

An enlarged disk 330 is secured to distal end 324 of drive shaft 320. In the embodiment depicted, disk 330 has a substantially cylindrical configuration that includes a proximal end face 332 and an opposing distal end face 334. Distal end 324 of drive shaft 320 is centrally secured to proximal end face 332. In contrast, stem 114 and rounded head 116 are mounted on distal end face 334 at a location spaced radially outward from the rotational axis of drive shaft 320. That is, stem 114 is eccentrically mounted on end face 334 in the same manner as discussed above with regard to cleaning apparatus 4.

It is noted that centrally positioning enlarged disk 330 at the end of drive shaft 320 helps to stabilize drive shaft 320 during the rotation of eccentrically mounted rounded head 116. In alternative embodiments, however, drive shaft 320 can have the same diameter as disk 330 or disk 330 can be eliminated and an arm formed between drive shaft 330 and stem 114. Other conventional techniques can also be used to eccentrically position rounded head 116. A cylindrical bushing 336 encircles drive shaft 320 toward distal end 324 and is supported within supports 338 formed on the interior surface of head housing 201.

As with cleaning apparatus 4 of FIG. 1, cleaning apparatus 200 includes brush head 14. Brush head 14 comprises carrier plate 122 having bottom surface 125 with brush 16 comprised of bristles formed thereon. Plate 122 also has top surface 124 with spindle 126 and arms 130 projecting therefrom. Axle 128 centrally projects from spindle 126 and has a rotational axis extending therethrough. A tubular bushing 340 is secured to upper head housing 22 and encircles axle 128 (FIG. 13). Axle 128 and spindle 126 are received within a hub 342 with a wear plate 341 (FIG. 12A) positioned between bushing 340 and spindle 126.

Figure 15:
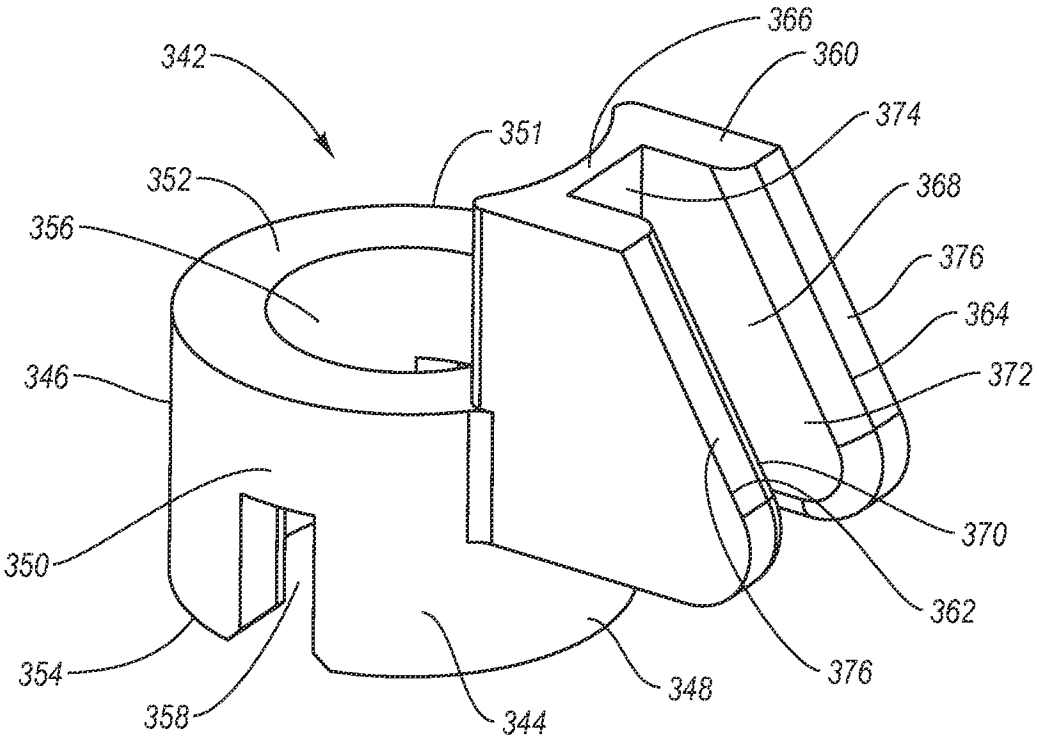
FIG. 15 is an enlarged perspective view of the hub shown in FIG. 12A.

As depicted in FIG. 15, hub 342 comprises a substantially cylindrical base 344 having a front face 346, a back face 348, and opposing side faces 350 and 351 which each extend between a top surface 352 and an opposing bottom surface 354. A passage 356 centrally extends through base 344 from top surface 352 to bottom surface 354. A side channel 358 extends through side surfaces 350 and 351 adjacent to bottom surface 354 so as to intersect with passage 356. Side channel 358 is configured so that when spindle 126 is received within passage 356, arms 130 are received within side channel 358 so that hub 342 is interlocked with brush head 14. Wear plate 341 (FIG. 12A) also has tabs projecting from the side thereof which are received within side channel 358 of hub 342 so that wear plate 341 is secured to hub 342. In one embodiment where bushing 340 is metal and spindle 126 is plastic, wear plate 341 prevents bushing 340 from producing undue wear on spindle 126, such as in the embodiment shown if FIG. 12A. In an alternative embodiment, hub 342 can be molded as part of brush head 14.

Projecting from back face 348 of base 344 is a guide 360. Guide 360 comprises a first side wall 362, a complementary spaced apart second side wall 364, and a back wall 366 extending therebetween. Guide 360 partially bounds a channel 368 that is vertically aligned with passage 356. Channel 368 is bounded by a first engagement surface 370, a spaced apart second engagement surface 372, and an inside face 374 extending therebetween. Engagement surfaces 370 and 372 are opposingly facing, are substantially flat, and are in substantially parallel alignment. The distance between engagement surfaces 370 and 372 of hub 342 is substantially equal to the diameter of rounded head 116.

Comparable to the embodiment depicted in FIG. 10 and as illustrated in FIG. 13 in conjunction with FIG. 15, rounded head 116 is received within channel 368. As rounded head 116 is continuously rotated about the rotational axis of drive shaft 320 due to the rotation of drive shaft 254, rounded head 116 alternatingly pushes against opposing engagement surfaces 370 and 372 so as to cause hub 342, brush head 14, and brush 16 to reciprocate in a rotational pattern about the rotation axis extending through spindle 126.

As with cleaning apparatus 4, in cleaning apparatus 200 the rotational axis of drive shaft 320 intersects with the rotational axis of brush head 14 so as to form an inside angle θ that is typically greater than 95° and more commonly in a range between about 110° to about 140° or the other angles previously discussed. As rounded head 116 travels in its circular pattern, rounded head 116 travels longitudinally along the length of side walls 362 and 364. Because of the above discussed angular orientation of brush head 14, rounded head 116 is disposed farther away from the rotational axis of brush head 14 when rounded head 166 is disposed at the bottom of side walls 362 and 364 and is closer to the rotational axis of brush head 14 when rounded head 166 is disposed at the top of side walls 362 and 364. Accordingly, to ensure that rounded head 166 is retained within channel 368 during its circular movement, side walls 362 and 364 can be wider at the bottom than at the top. In one embodiment, side channel 368 of hub 342 may also be lined with an angular metal surface to add additional wear characteristics to surfaces 376, 370 and 372, as shown in FIG. 15.

In one embodiment rounded head 116 has a substantially spherical configuration. This design has a number of benefits. For example, in part because of the above discussed angular orientation of brush head 14, rounded head 116 contacts engagement surfaces 370 and 372 along a number of different points on rounded head 116 that are longitudinally spaced proximal to distal and top to bottom. By making rounded head 116 spherical, this helps to ensure continued minimal contact between rounded head 116 and engagement surfaces 370 and 372 so as to minimize wear.

Furthermore, due to tolerances in mounting brush head 14, on occasion as brush 16 is biased against a surface for cleaning, brush head 14 will tilt slightly causing the distal end of rounded head 116 to bias against inside face 374 of hub 342 (FIG. 15). This contact between rounded head 116 and inside face 374 helps to stabilize and reinforce brush head 14. By making rounded head 116 spherical, the contact surface between rounded head 116 and inside face 374 is minimized. It is also noted that both of side walls 362 and 364 terminate at an outside edge 376. These outside edges 376 are designed so that they can bias against distal end face 334 of disk 330 as brush head 14 is tilted during use so as to also help stabilize and reinforce brush head 14.

Figure 16:
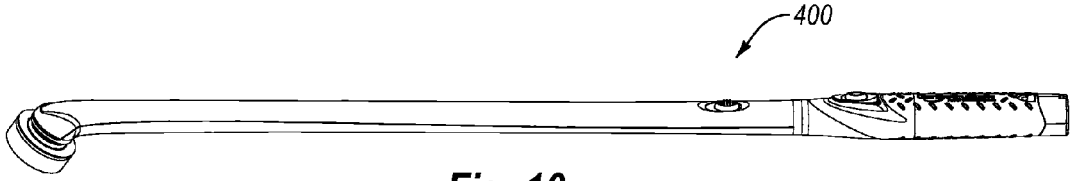
FIGS. 16-18 are perspective views of an alternative embodiment of a cleaning apparatus according to the present invention.
Figure 17:
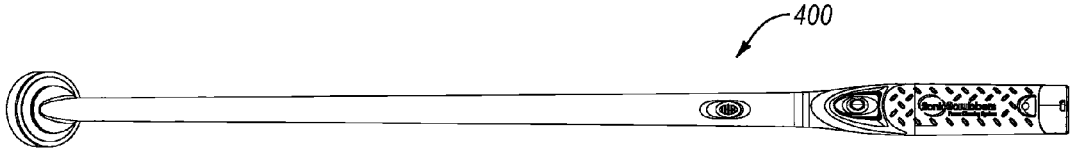
Figure 18:
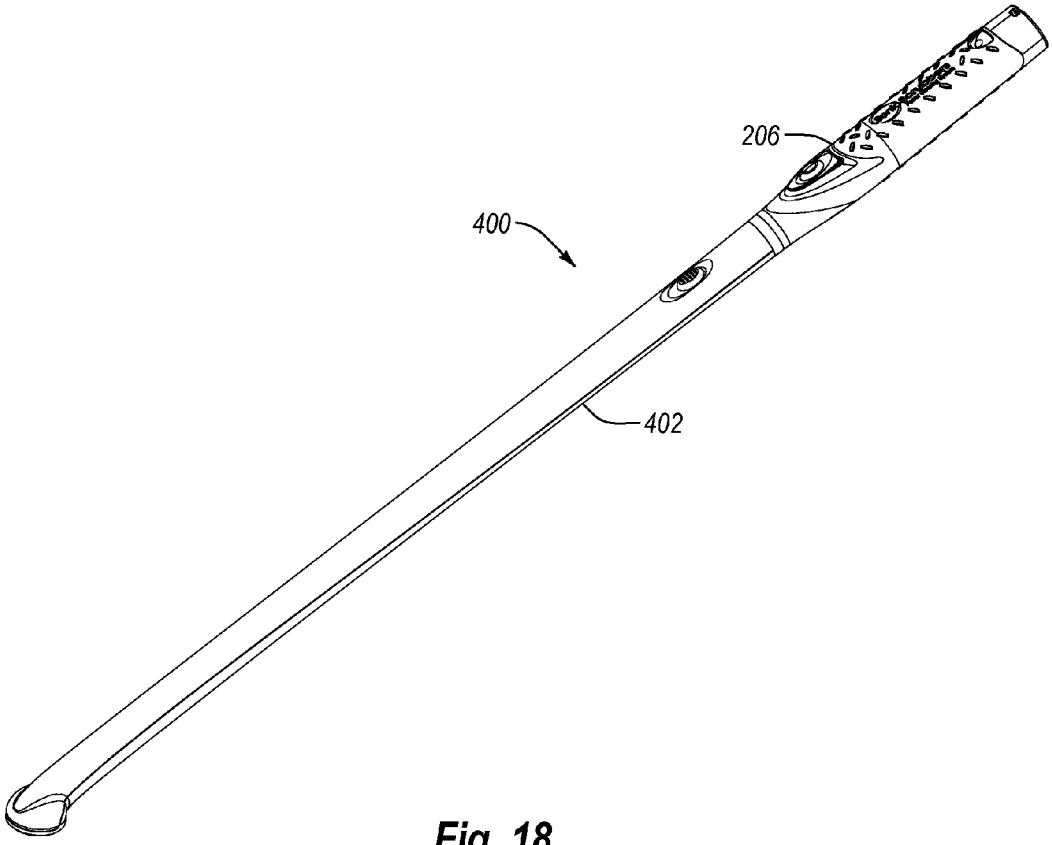

Depicted in FIGS. 16-18 is an alternative embodiment of a cleaning apparatus 400 incorporating features of the present invention. Cleaning apparatus 400 can be used to clean toilets, shower walls, glass partitions, and bathtubs, among other things. Cleaning apparatus 400 incorporates body assembly 206 discussed above, with an elongated head assembly 402 releasably attached thereto. Like elements between head assemblies 202 and 402 are identified by like reference characters.

When attached together, body assembly 206 and head assembly 402 combine to have a substantially cylindrical configuration with a length that is typically in a range between about 40 cm to about 75 cm with about 55 cm to about 65 cm being more common. Other dimensions can also be used. In alternative embodiments housing 36 can have a variety of other configurations.

Figure 19:
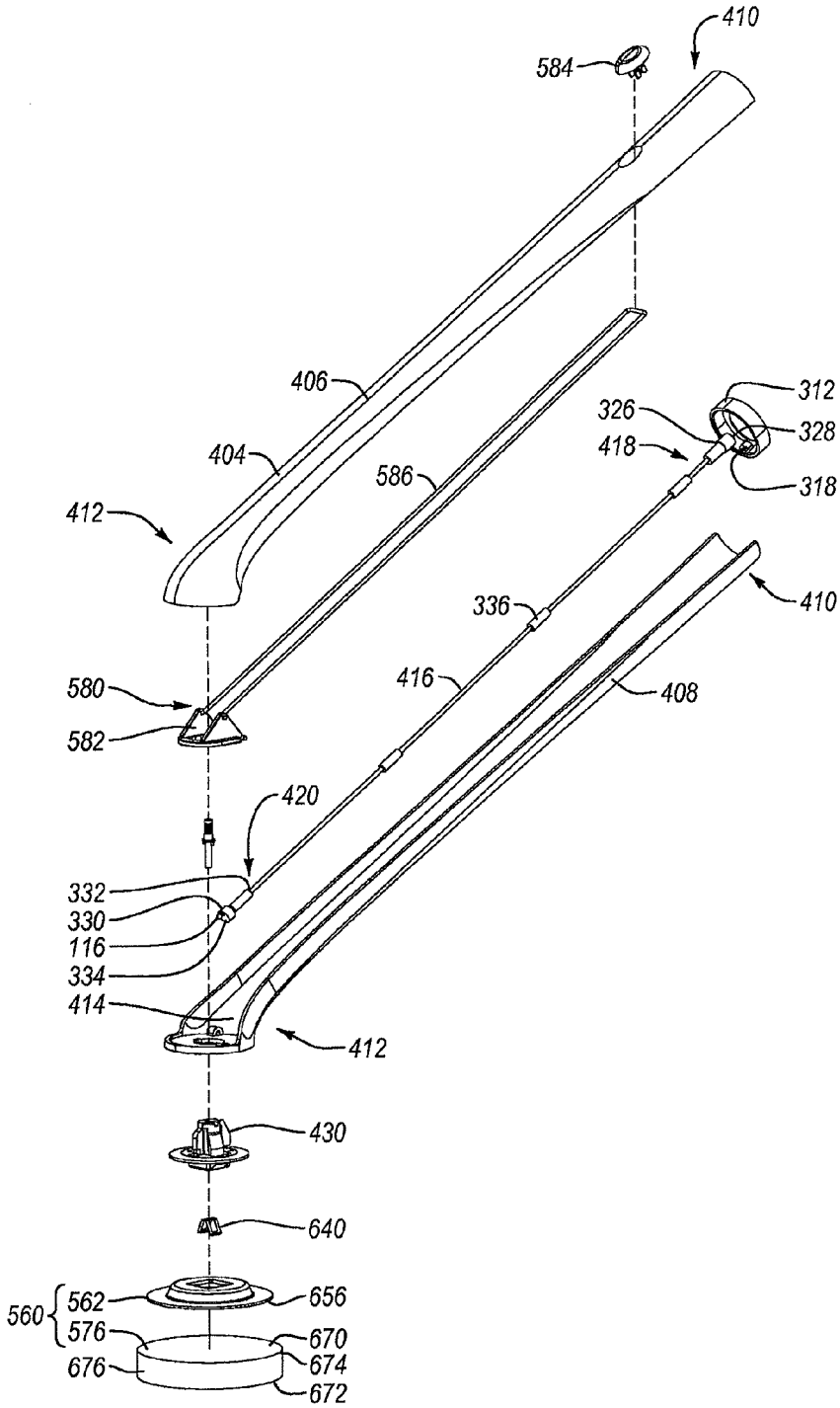
FIG. 19 is an exploded perspective view of a portion of the cleaning apparatus shown in FIGS. 16-18.

Head assembly 402 is similar to head assembly 202 except that head assembly 402 is designed so as to facilitate easier cleaning of toilets and other spaces that require a long reach. Turning to FIG. 19, similar to head assembly 202, head assembly 402 comprises a head housing 404 which includes an upper head housing 406 and a lower head housing 408 each having a proximal end 410 and an opposing distal end 412. Head housing 404 bounds a channel 414 extending along the length thereof. Although not shown in the depicted embodiment, channel 414 can be at least partially divided by complementary partition walls formed on housing 406 and 408 (see, e.g., partition walls 338 shown in FIG. 12A).

Figure 20:
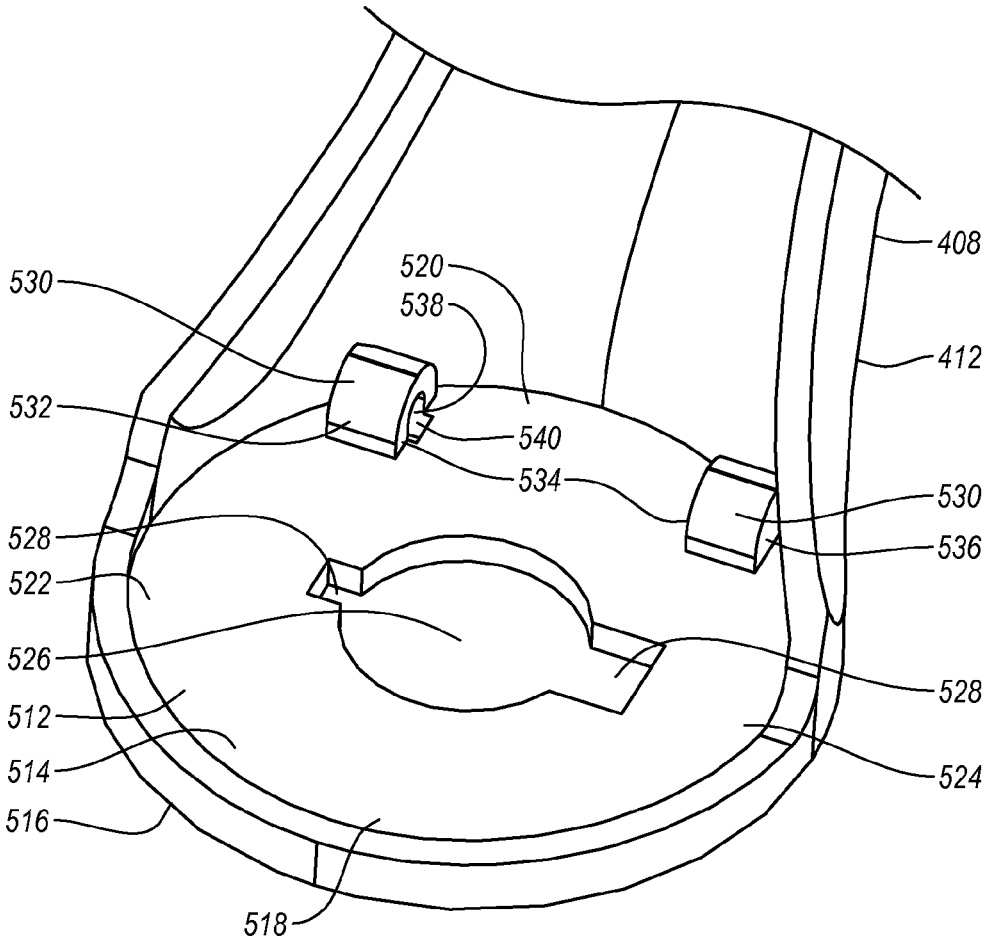
FIG. 20 is a top perspective view of a portion of the lower head housing shown in FIG. 19.

As shown in FIG. 20, distal end 412 of lower head housing 408 includes a flat circular section 512 having a top surface 514 and an opposing bottom surface 516 that extends from a front side 518 to a back side 520 between two lateral sides 522 and 524. A passage 526 is formed in circular section 512 that extends between top and bottom surfaces 514 and 516 so as to extend completely through circular section 512. Passage 526 is substantially round with opposing notches 528 formed on either lateral side thereof.

Projecting up from top surface 514 is a pair of projections 530. Each projection 530 has a side surface 532 extending between an inner face 534 and an opposing outer face 536. Projections 530 are disposed on back side 520 on either lateral side of passage 526 so that inner faces 534 are facing each other. Each projection 530 has a bore 538 formed therein having a mouth 540 formed on inner face 534. Bores 538 are formed so as to be aligned with each other.

Returning to FIG. 19, secured between upper and lower head housings 406 and 408 at proximal end 410 is engagement ring 312. As noted above, engagement ring 312 has an opposing bayonet prong 318 formed on an interior surface thereof. Similar to head assembly 202, head assembly 402 is removably secured to body assembly 204 by inserting stem 216 of body housing 206 within proximal end 410 of head assembly 402 so that bayonet prongs 318 are received within bayonet slots 217 and then rotating head assembly 402 relative to body assembly 204.

Continuing with FIG. 19, head assembly 402 comprises a drive shaft 416 that is similar to drive shaft 320 except that drive shaft 416 is longer. As such, drive shaft 416 also has a proximal end 418 with coupler 326 secured thereto and an opposing distal end 420 with enlarged disk 330 secured thereto. Because of the length of drive shaft 416, one or more cylindrical bushings 336, as described above, encircle drive shaft 416 along the length thereof. Although not shown, bushings 336 can be supported within supports formed on the interior surface of head housing 404, such as supports 338 shown in FIG. 12A.

As described above, socket 328 formed on the free end of coupler 326 is designed to removably engage with head 255 on drive shaft 254 extending from motor 60. Specifically, socket 328 has a configuration complementary to head 255 such that when head 255 is received within socket 328, rotation of drive shaft 254 causes rotation of drive shaft 416. Head 255 is removably received within socket 328 when head assembly 402 is removably coupled with body assembly 204 as discussed above.

As also discussed above, disk 330 has a substantially cylindrical configuration that includes a proximal end face 332 and an opposing distal end face 334. Distal end 420 of drive shaft 416 is centrally secured to proximal end face 332. In contrast, stem 114 and rounded head 116 are mounted on distal end face 334 at a location spaced radially outward from the rotational axis of drive shaft 416. That is, stem 114 is eccentrically mounted on end face 334. Other configurations are also possible, as discussed above.

Figure 25:
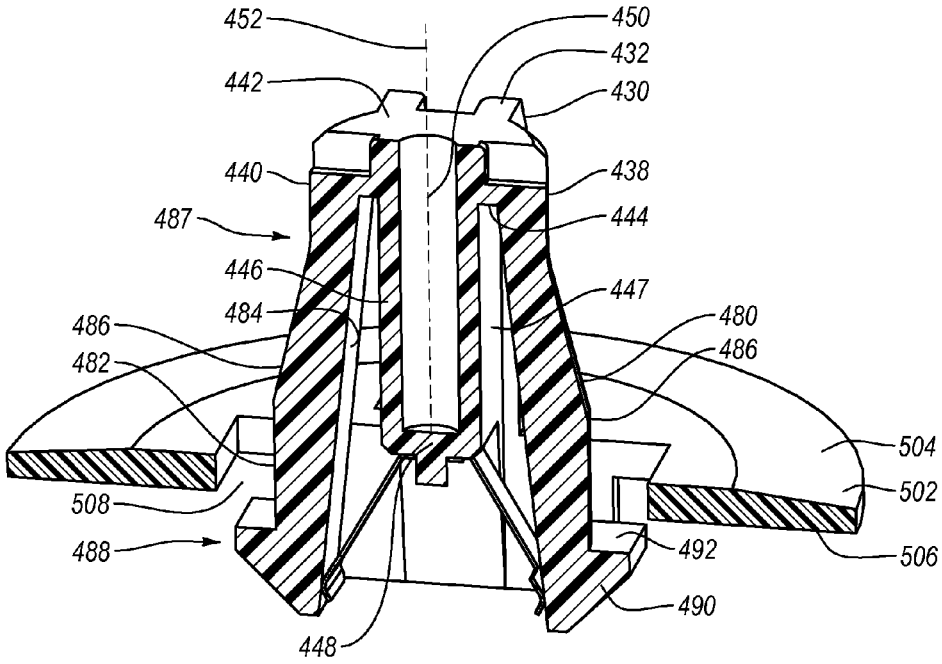
FIG. 25 is a cross sectional side view of the hub and leaf spring shown in FIG. 19 with the leaf spring attached to the hub.

Similar to cleaning apparatus 200, cleaning apparatus 400 includes a hub 430 to which head 116 is coupled. As depicted in FIGS. 21-26, hub 430 comprises a base 432 having a front face 434, a back face 436, and opposing side faces 438 and 440 which each extend downward from a top surface 442. As shown in FIG. 25, base 432 also includes a bottom surface 444. A projection 446 having an external surface 447 centrally extends downward from bottom surface 444 to a bottom wall 448. A cylindrical passage 450 having a rotational axis 452 extending therethrough centrally extends through top surface 442 and into projection 446.

Figure 22:
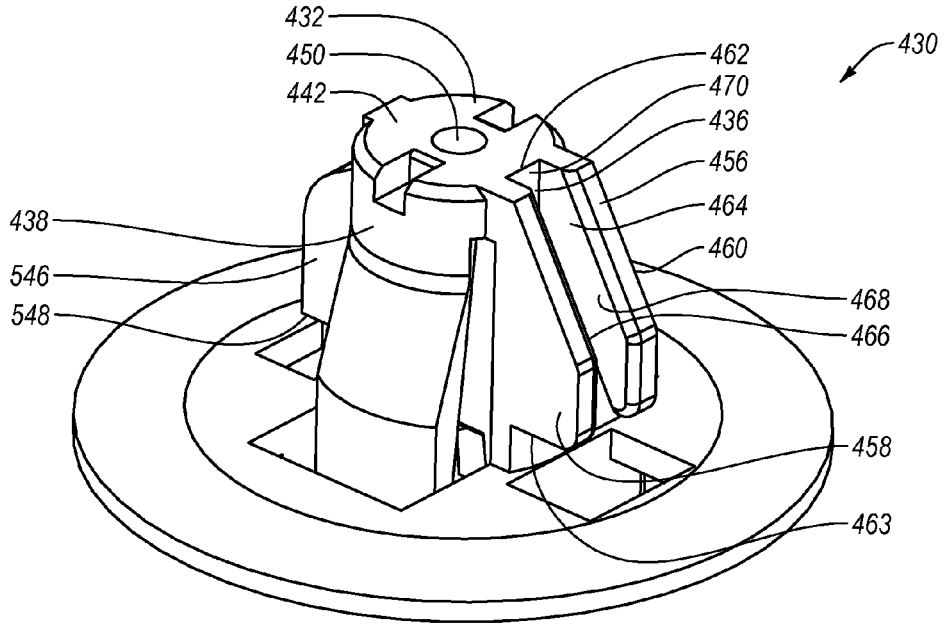
Figure 23:
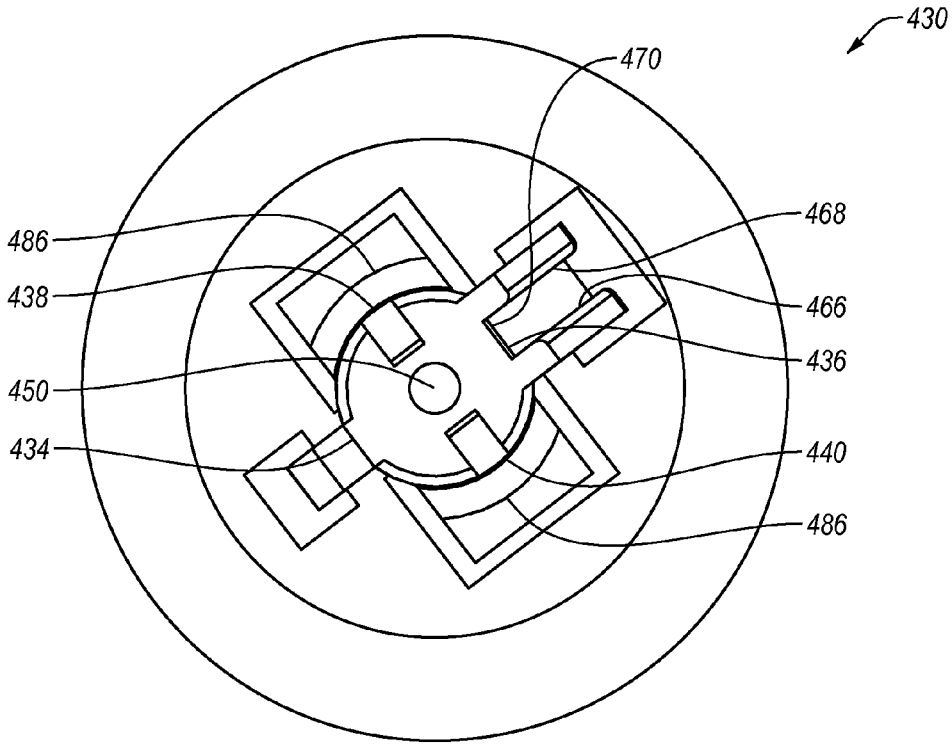
FIG. 23 is a top plan view of the hub shown in FIG. 19.
Figure 24:
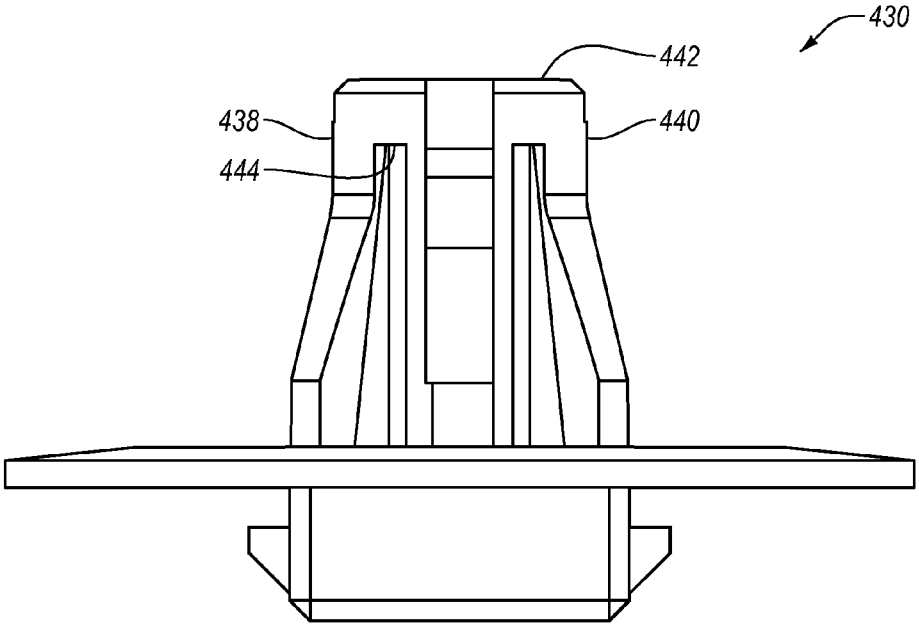
FIG. 24 is an elevated front view of the hub shown in FIG. 19.

As best shown in FIGS. 22 and 23, projecting from back face 436 of base 432 is a guide 456. Guide 456 is substantially similar to guide 360, discussed previously, and is used in a similar manner. As such, guide 456 comprises first side wall 458, a complementary spaced apart second side wall 460, and a back wall 462 extending therebetween. Side walls 458 and 460 each extends to a bottom surface 463. Guide 456 partially bounds a channel 464 that is vertically aligned with passage 450. Channel 464 is bounded by a first engagement surface 466, a spaced apart second engagement surface 468, and an inside face 470 extending therebetween. Engagement surfaces 466 and 468 are opposingly facing, are substantially flat, and are in substantially parallel alignment. The distance between engagement surfaces 466 and 468 of hub 430 is substantially equal to the diameter of rounded head 116.

Figure 36:
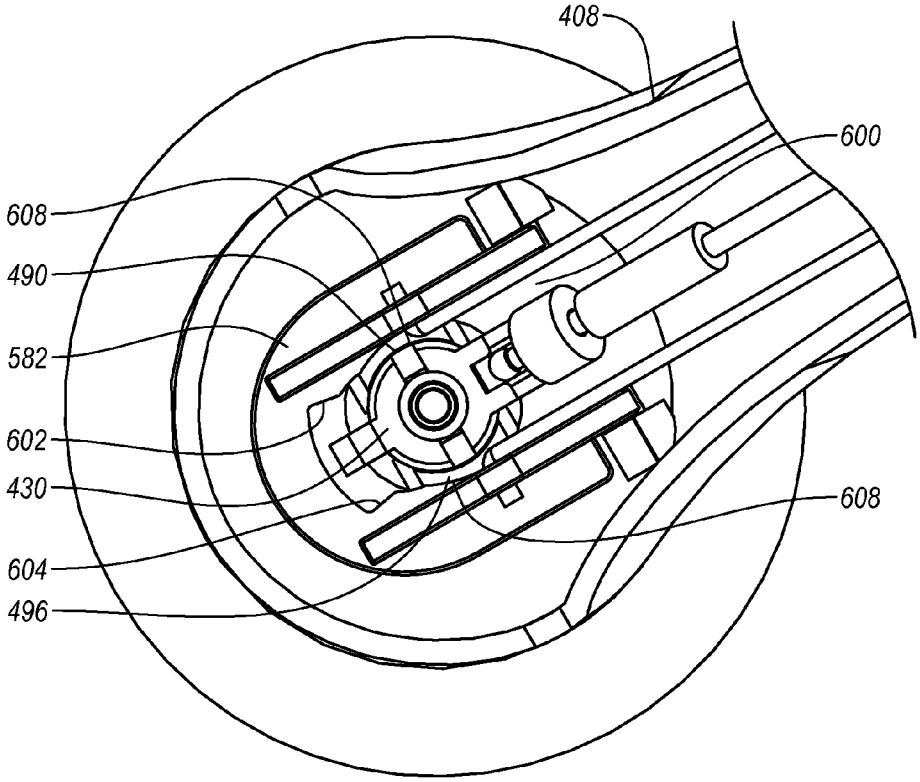
FIG. 36 is a top view of a hub and disengaging member disposed within a portion of the lower head housing.

Similar to the embodiment using guide 360, discussed previously, rounded head 116 is received within channel 464 (see FIG. 36). As rounded head 116 is continuously rotated about the rotational axis of drive shaft 416 due to the rotation of drive shaft 254, rounded head 116 alternatingly pushes against opposing engagement surfaces 466 and 468 so as to cause hub 430 to reciprocate in a rotational pattern about the rotational axis 452 extending through passage 450, in a similar manner to that described in previously discussed embodiments.

As best shown in FIG. 25, projecting downward from top surface 442 along side surfaces 438 and 440 is a pair of resilient arms 480 and 482. Each arm 480 and 482 has an inner surface 484 and an opposing outer surface 486 extending from a proximal end 487 near top surface 442 to a distal end 488. Arms 480 and 482 extend beyond bottom wall 448 of projection 446 so that distal ends 498 of arms 480 and 482 are disposed below bottom wall 448. Arms 480 and 482 angle away from external surface 447 of projection 446 as they extend toward distal end 488. This causes a gap to be formed between external surface 447 and each outer surface 486. As shown in FIG. 23, when viewed from above outer surfaces 486 form opposing arcs having as their axis the rotational axis 452 that passes through passage 450. The arcs get progressively larger as the arms extend from proximal end 487 to distal end 488. Arms 480 and 482 are configured to be squeezed toward each other, as discussed in more detail below.

Figure 50:
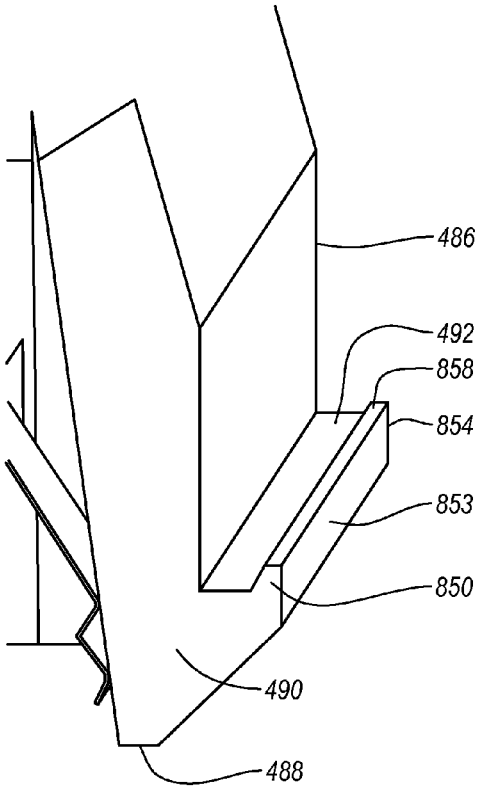
FIG. 50 is a close up perspective view of an alternative embodiment of an arm having a catch formed on the lip of the barb.

As shown in FIG. 25, disposed at the distal end 488 of each arm 480 and 482 is a barb 490 that extends laterally out from the outer surface 486 so as to form an upwardly facing lip 492. Lip 492 is used to retain a removable cleaning head, as discussed below. If desired, retaining means can be positioned on lip 492 to help retain the removable cleaning head thereon. For example, as shown in FIG. 50, the retaining means can comprise a catch 854 formed on lip 492. Catch 854 can be positioned on the outer edge of lip 492 and can comprise an inner side surface 850 and an opposing outer side surface 853 that each extend upward from lip 492 to a top surface 858. If desired, the inner side surface 850 can be curved. This catch 854 can match a corresponding groove formed in the removable cleaning head, as discussed below to better retain the cleaning head during use.

Disposed towards the distal end of hub 430 is a retaining ring 502. Retaining ring 502 is substantially orthogonal to rotational axis 452 and is disposed so as to be vertically higher than lip 492. Retaining ring 502 comprises a top surface 504 and an opposing bottom surface 506. A passage 508 is formed in retaining ring 502 that extends completely therethrough between the top and bottom surfaces 504 and 506. Passage 508 is shaped so as to allow arms 480, and 482 to pass therethrough on either lateral side thereof.

Figure 26:
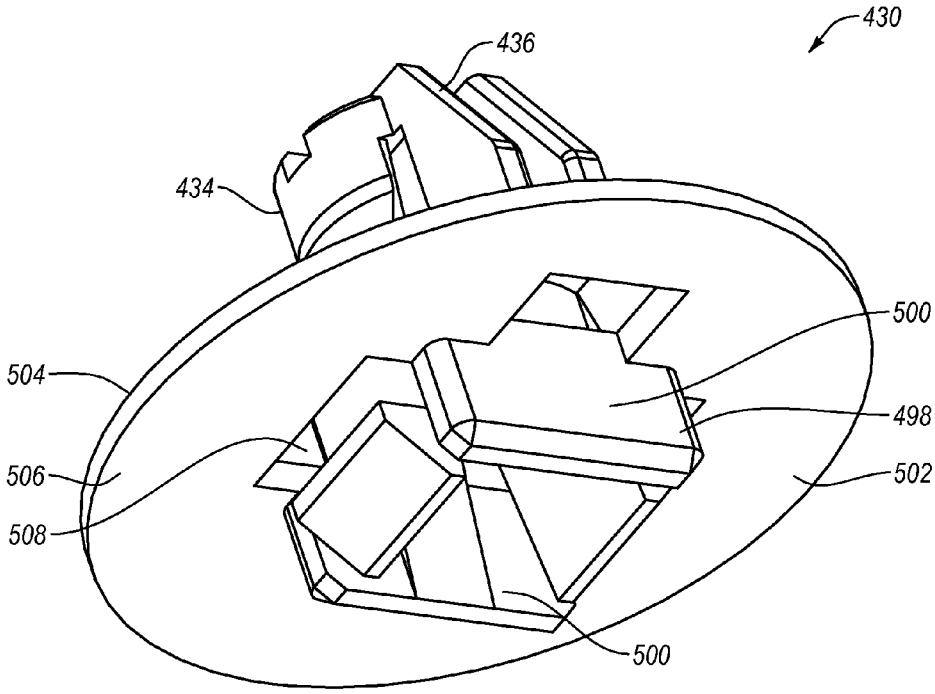
FIG. 26 is a bottom perspective view of the hub shown in FIG. 19.

As shown in FIG. 26, projecting downward from retaining ring 502 on the front and back sides of passage 508 are a pair of tabs 500 that extend to a distal end 498.

Figure 21:
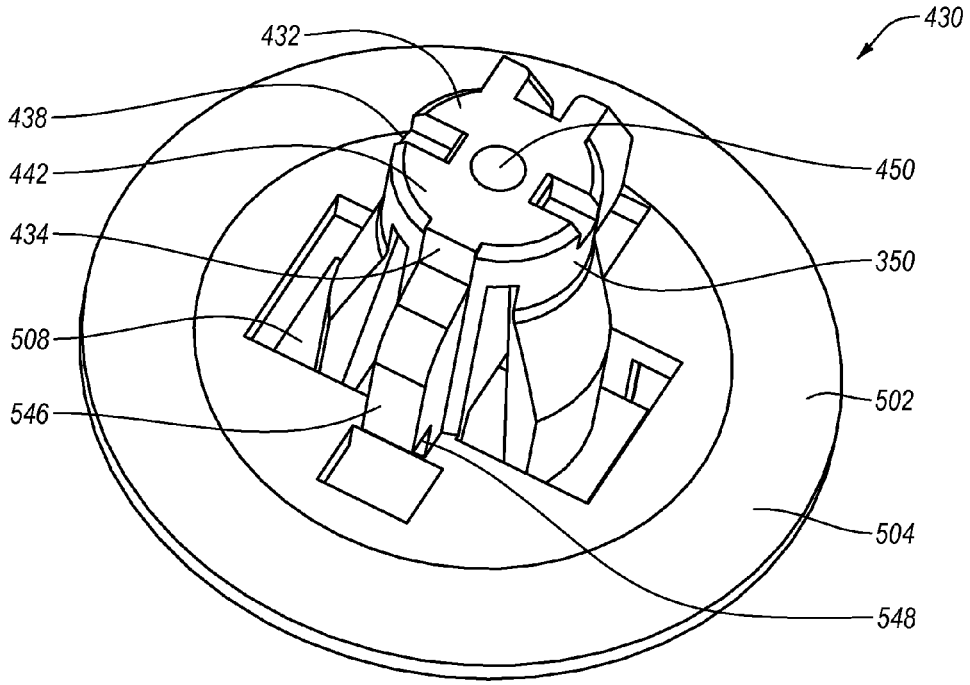
FIGS. 21 and 22 are top perspective views of the hub shown in FIG. 19.

As shown in FIG. 21, projecting from front face 434 of base 432 is a securing member 546. Securing member has a bottom surface 548 that extends away from front face 434.

Figure 27:
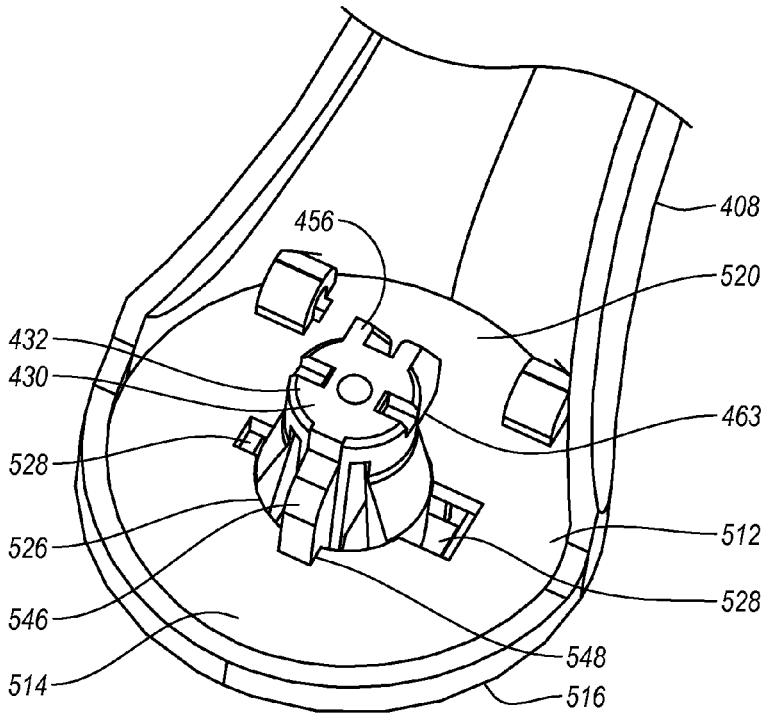
FIG. 27 is a top perspective view of the portion of the lower head housing shown in FIG. 20, with a hub attached thereto.

Turning to FIG. 27, to attach hub 430 to lower head housing 408, hub 430 is positioned below circular section 512 of lower head housing 408 so that base 432 is aligned with passage 526. Hub 430 is rotated about its rotational axis 452 until guide 456 and securing member 546 are aligned with notches 528 of passage 526. Hub 430 is then pushed up through passage 526 until guide 456 and securing member 546 are completely through passage 526. Hub 430 is then rotated so that guide 456 generally faces toward the back side 520 of circular section 512 of lower head housing 408, as shown in FIG. 27. In this position, bottom surfaces 463 and 548 of guide 456 and securing member 546 rest on top surface 514 of circular section 512 and top surface 504 of retaining ring 502 is disposed adjacent to bottom surface 516 of circular section 512. As a result, hub 430 is loosely secured to lower head housing 408. The surfaces 463, 548, and 504 adjacent to circular section 512 are not rigidly connected thereto so as to be able to slide back and forth on circular section 512 when hub 430 is reciprocally rotated.

Figure 28:
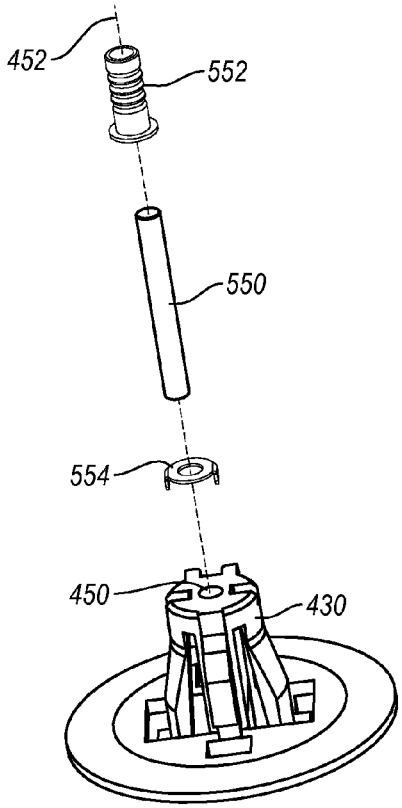
FIG. 28 is an exploded perspective view of the hub shown in FIG. 18 with additional attached elements.

Turning to FIG. 28, an axle 550 centrally projects from passage 450 so that rotational axis 452 extends therethrough. A tubular bushing 552 is secured to upper head housing 406 and encircles axle 550. A wear plate 554 is positioned between bushing 552 and hub 430. Axle 550, bushing 552 and wear plate 554 are used in a similar manner as embodiments discussed previously.

Returning to FIG. 19, whereas cleaning apparatus 200 includes a non-removable brush head 14, cleaning apparatus 400 includes a cleaning head 560 configured to be selectively removable from head assembly 402. Cleaning head 560 comprises a carrier plate 562 with a cleaning pad 576 attached thereto. Similar to the cleaning apparatuses discussed previously, in cleaning apparatus 400 the rotational axis of drive shaft 320 intersects with the rotational axis of cleaning head 560 so as to form an inside angle that is typically greater than 95° and more commonly in a range between about 110° to about 140° or the other angles previously discussed.

Figure 29:
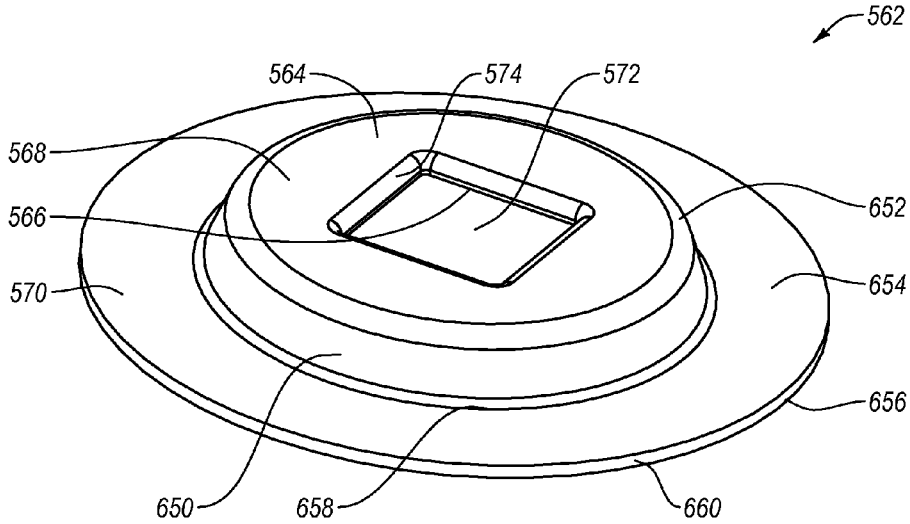
FIG. 29 is a top perspective view of the carrier plate shown in FIG. 19.

Turning to FIG. 29, carrier plate 562 comprises a substantially circular inner portion 568 and an annular outer portion 570 with a connecting wall 650 extending therebetween. Inner portion 568 comprises a top surface 564 and an opposing bottom surface 566 extending radially to an outer edge 652. Top and bottom surfaces 564 and 566 are substantially planar and parallel to each other. An aperture 572 is centrally formed on inner portion 568 so as to extend completely therethrough between top and bottom surfaces 564 and 566. Aperture 572 is bounded by an inner side surface 574 that extends between top and bottom surfaces 564 and 566. Aperture 572 is depicted as being generally square, but other shapes are also possible. If a catch 854 is used on lip 492, as discussed above, a corresponding groove 855 (FIG. 51) can be formed on bottom surface 566 of carrier plate 562. The catch/groove combination can help to more securely fasten carrier plate 562 to head assembly 402, as discussed in more detail below.

Outer portion 570 comprises a top surface 654 and an opposing bottom surface 656 that radially extend between an inner edge 658 and an outer edge 660. Similar to top and bottom surfaces 564 and 566 of inner portion 568, top and bottom surfaces 654 and 656 of outer portion 570 are substantially planar and parallel to each other. Top and bottom surfaces 654 and 656 can also be substantially parallel to top and bottom surfaces 564 and 566, as in the depicted embodiment.

As shown in the depicted embodiment, outer portion 570 is disposed below inner portion 568 so as to be further away from head assembly 402. Connecting wall 650 runs all the way around inner portion 568, extending from outer edge 652 of inner portion 568 to inner edge 658 of outer portion 570. In the depicted embodiment, connecting wall 650 is substantially orthogonal, although this is not required.

Returning to FIG. 19, cleaning head 560 further comprises a cleaning pad 576 secured to bottom surface 656 of outer portion 570 of carrier plate 562. Cleaning pad 576 has a top surface 670 and an opposing bottom surface 672 that radially extend to an outer edge 674 with an encircling perimeter sidewall 676 extending between top and bottom surfaces 670 and 672. Top surface 670 attaches to carrier plate 562 by adhesive or the like, and bottom surface 672 is used as a scrubbing surface.

In the depicted embodiment, cleaning pad 576 is substantially circular, having a larger diameter than carrier plate 562. As a result, sidewall 676 of cleaning pad 576 can also be used as a scrubbing surface to help clean along with bottom surface 672. This is especially helpful when cleaning, e.g., toilets. Cleaning pad 576 can comprise a sponge, a scouring pad, a mesh pad, or any other type of cleaning pad made of any commercially available scrubbing material, such as steel wool, foam, cloth, plastic, microfiber, nylon, polyester, or the like. The material can be woven or non-woven. If desired, any of the scrubbing surfaces of cleaning pad 576, such as bottom surface 672 or sidewall 676, can be coated with additional scrubbing material, such as metal powder or resins to stiffen the scrubbing surface and/or make the scrubbing surface more abrasive. Additionally, any of the scrubbing surfaces can be impregnated with a cleaning solution, if desired. For softer cleaning, such as for buffing, cleaning pad 576 can alternatively be made of sheepskin, foam, or other material. Of course, a brush, such as brush 16, discussed above, can alternatively be formed on bottom surface 656 of carrier plate 562 instead, if desired.

Figure 30:
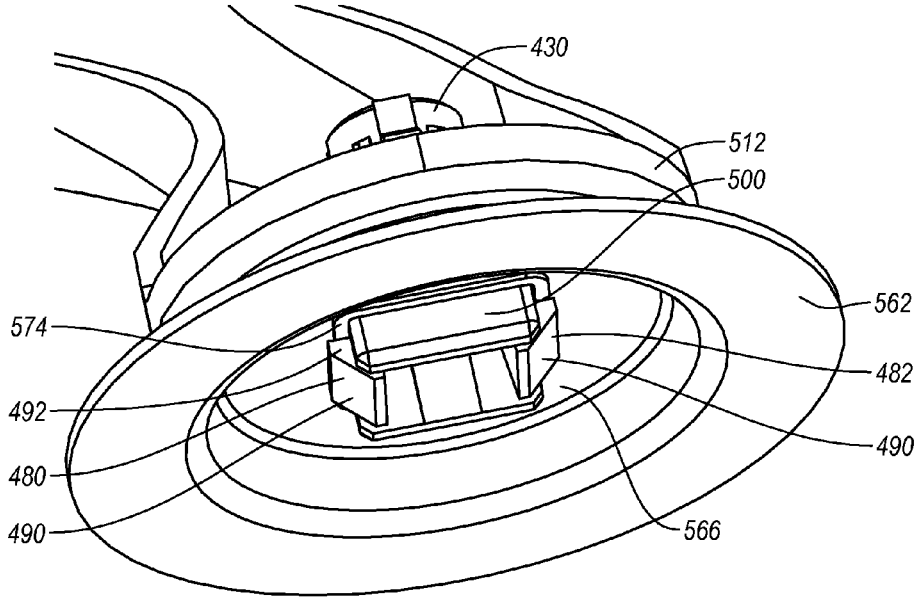
FIG. 30 is a bottom perspective view of the carrier plate attached to the hub.
Figure 51:
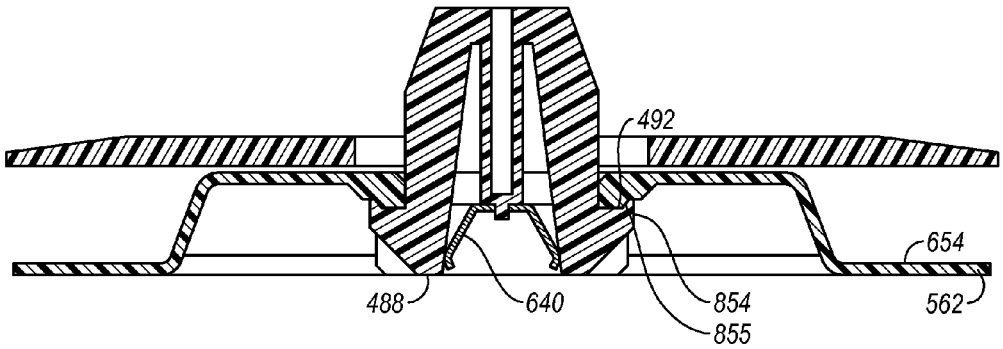
FIG. 51 is a cross sectional side view of an attached hub and carrier plate respectively having a catch and groove.

To attach cleaning head 560 to head assembly 402, carrier plate 562 is positioned below circular section 512 so that the four sides of aperture 572 are aligned with arms 480 and 482 and tabs 500 of hub 430 extending down through passage 508 of retaining ring 502. Arms 480 and 482 are forced towards each other so as to cause barbs 490 to move inward until barbs 490 do not overlap with the inner side surface 574 bounding aperture 572. Carrier plate 562 is then pushed up towards hub 430 so that distal ends 488 and 498 of arms 480, 482 and tabs 500 extend through aperture 572. Once bottom surface 566 of carrier plate 562 is vertically above lip 492, arms 480 and 482 are allowed to revert back to their normal position, causing lips 492 to overlap bottom surface 566, as shown in FIGS. 30 and 51. As a result, carrier plate 562 is rigidly secured to hub 430. As particularly shown in FIG. 51, if catches 854 and grooves 855 are used, each catch 854 can become locked into position within a groove 855, thereby further preventing the unintended release of carrier plate 562 from hub 430 during aggressive use, such as, e.g., when angular pressure is applied to the cleaning head while cleaning a toilet bowl.

To remove carrier plate 562 from head assembly 402, arms 480 and 482 are again forced towards each other so as to cause barbs 490 to move inward until lips 492 are not overlapping bottom surface 566 of carrier plate 562. When this occurs, carrier plate 562 can be removed by simply pulling carrier plate away from hub 430. In some embodiments, gravity is a sufficient force to cause the separation of carrier plate from hub 430 when arms have been squeezed together. In those embodiments, the user can remove and discard cleaning head 560 without having to manually handle it.

Figure 31:
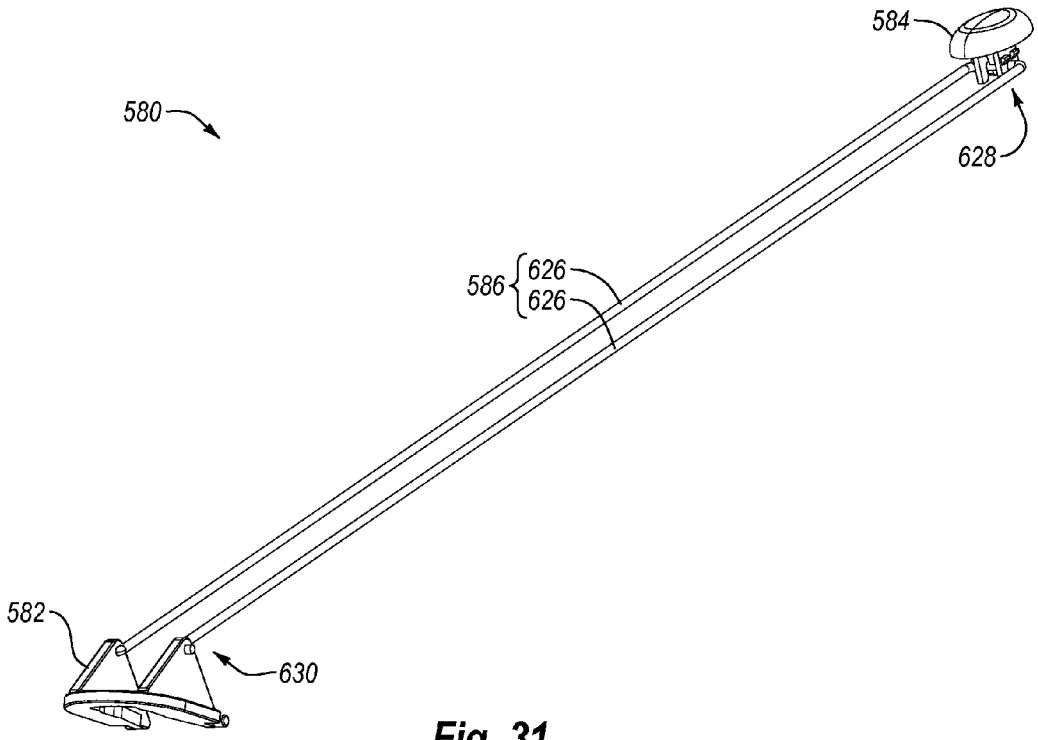
FIG. 31 is a side perspective view of the disengaging system shown in FIG. 19.

Returning to FIG. 19, to facilitate the attachment and removal of cleaning head 560, a disengaging system 580 is used. Turning to FIG. 31, disengaging system 580 comprises a disengaging member 582, an actuator 584, and a linkage 586 between actuator 584 and disengaging member 582.

Figure 32:
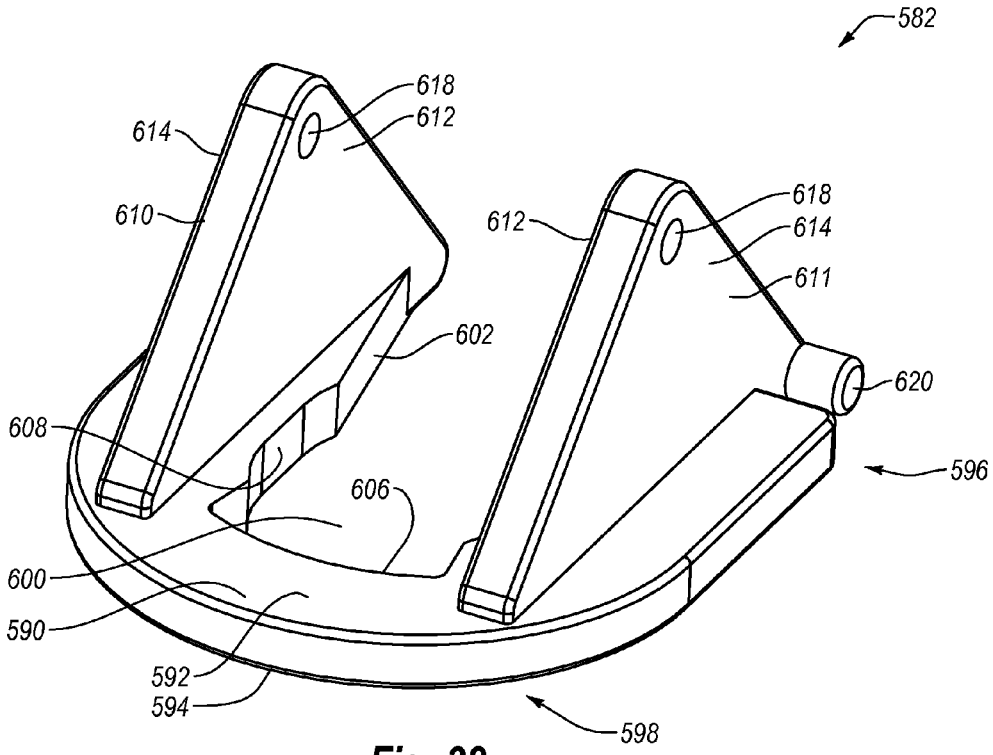
FIGS. 32 and 33 are perspective views of the disengaging member shown in FIG. 31.
Figure 33:
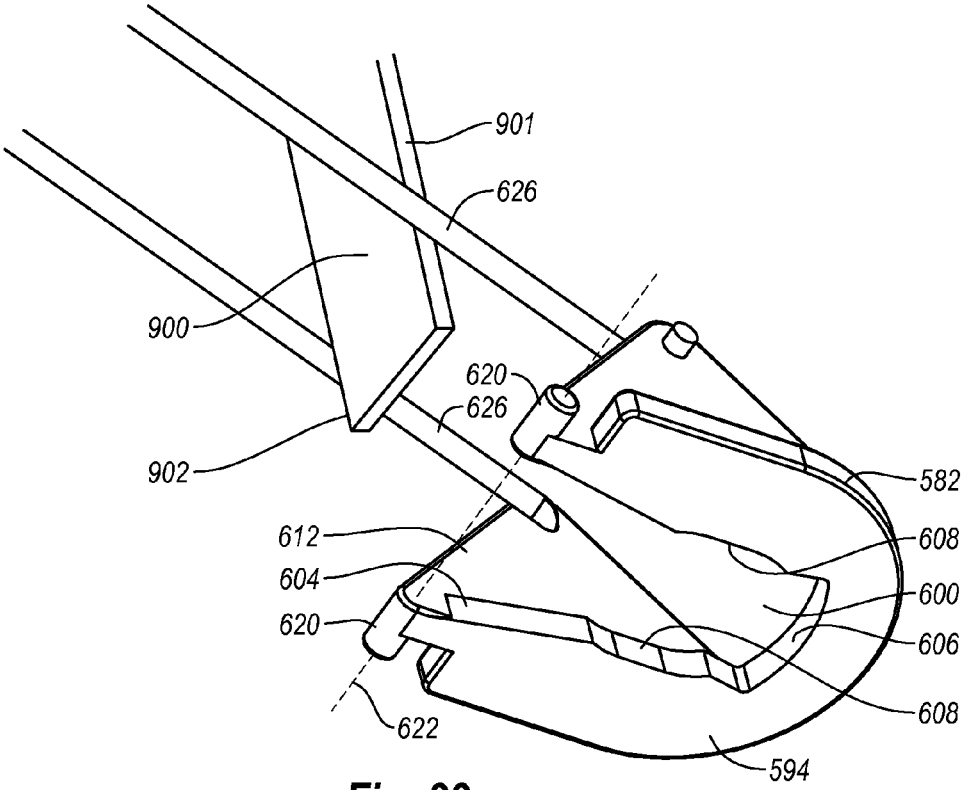

As shown in FIGS. 32 and 33, disengaging member 582 comprises a main body 590 having a top surface 592 and an opposing bottom surface 594 extending between a proximal end 596 and a distal end 598. A channel 600 is formed in main body 590 so as to extend completely through top and bottom surfaces 592 and 594. Channel 600 extends from proximal end 596 toward distal end 598 so as to cause main body 590 to be substantially u-shaped. Channel 600 is bounded by a pair of inner side surfaces 602 and 604 that extend from proximal end 596 to an end surface 606. Surfaces 602, 604, and 606 all extend completely through main body 590 between top and bottom surfaces 592 and 594.

Inner side surfaces 602 and 604 each are shaped so as to have a curved section 608 formed thereon. Curved sections 608 are disposed on side surfaces 602 and 604 so as to generally form opposing arcs of a circle.

Projecting up from top surface 592 of main body 590 is a pair of linkage arms 610 and 611, each having an inner side surface 612 and an opposing outer side surface 614 with a perimeter side wall 616 extending therebetween. Linkage arms 610 and 611 are disposed on either side of channel 600 and are substantially parallel to each other. As shown in the depicted embodiment, each linkage arm 610 is substantially triangular shaped with two of the corners of the triangle being positioned on main body 590, although this is not required. A linkage hole 618 is formed on each linkage arm 610 at the third corner of the triangle. Each linkage hole 618 extends all the way through linkage arm 610 between side surfaces 612 and 614. Linkage holes 618 are disposed on linkage arms 610 so as to be aligned with each other.

Figure 34:
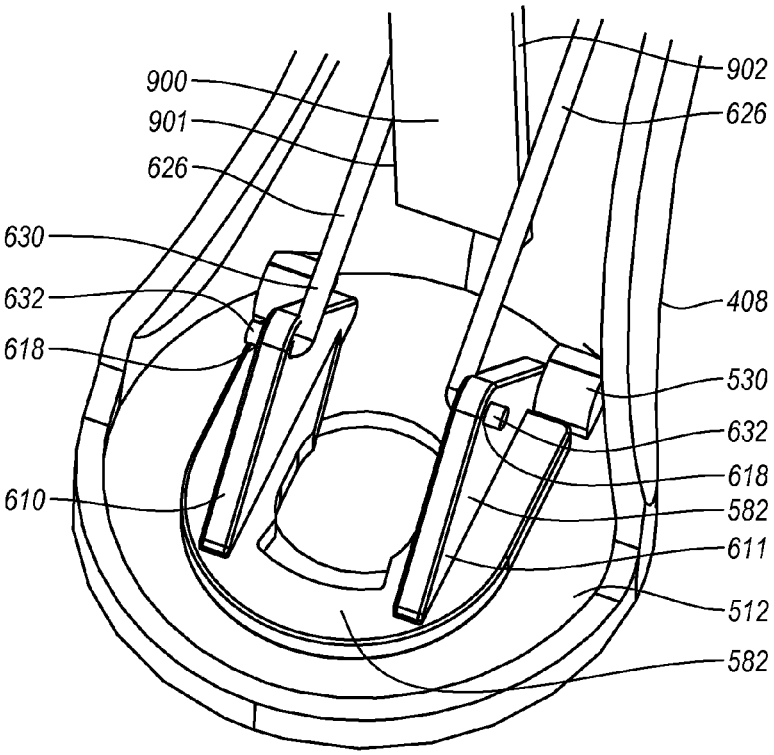
FIG. 34 is a top perspective view of the portion of the lower head housing shown in FIG. 20, with a disengaging member attached thereto.

Extending laterally away from outer surface 614 of each linkage arm 610 at proximal end 596 is a cylindrical mounting tab 620. Mounting tabs 620 are aligned with each other along a rotational axis 622. As shown in FIG. 34, disengaging member 582 is mounted to lower head housing 408 by inserting mounting tabs 620 into bores 538 of projections 530 disposed on circular section 512. Disengaging member 582 can then be pivoted about mounting tabs 620.

Figure 35:
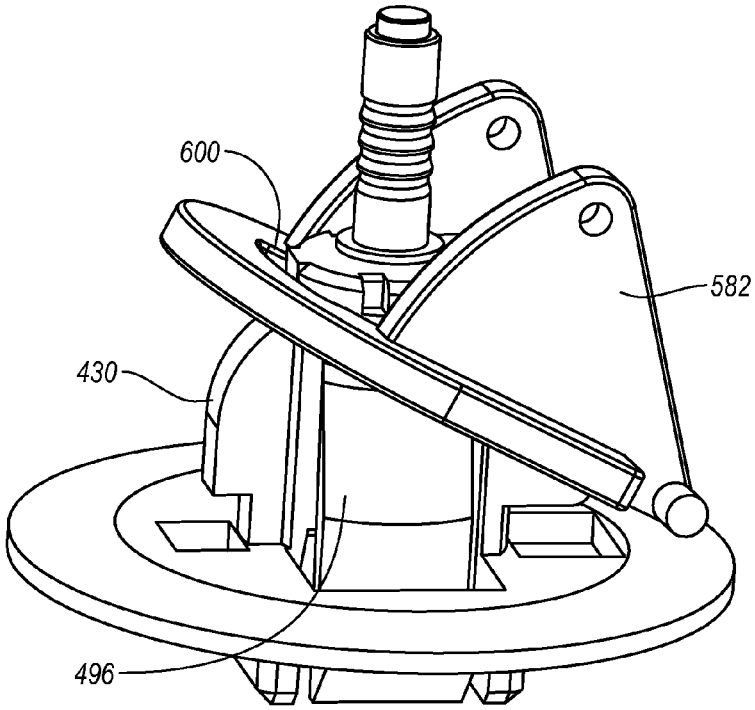
FIG. 35 is a side perspective view of a hub and disengaging member.

As shown in FIGS. 35 and 36, when disengaging member 582 is mounted on lower head housing 408, channel 600 is positioned so as to receive hub 430 therein. In particular, arms 494 and 496 of hub 430 are positioned adjacent to the curved sections 608 of inner side surfaces 602 and 604. As such, during reciprocating motion of hub 430, arms 494 and 496 remain positioned adjacent to the curved sections 608.

Returning to FIG. 31, to facilitate rotation of disengaging member 582, linkage 586 is attached to disengaging member 582. Linkage 586 comprises a pair of linkage rods 626 extending longitudinally in a substantially parallel manner from a proximal end 628 to a spaced apart distal end 630. As shown in FIG. 34, at distal end 630, each linkage rod 626 is bent outward, away from each other, to form an attachment section 632. Attachment sections 632 are inserted through linkage holes 618 in linkage arms 610 and 611 to attach linkage rods 626 to disengaging member 582. In this attached position, disengaging member 582 can be caused to pivot about mounting tabs 620 positioned within bores 538 by simply moving the linkage arms 610 along their longitudinal direction. It is appreciated that instead of two separate linkage rods 626, a single rod, bent so as to have two parallel sections can alternatively be used (e.g., see FIG. 37).

If desired, a tab or other mechanism can be used to prevent the rods from unintentionally disengaging from the linkage arms. For example, as shown in FIGS. 33 and 34, a rectangular tab 900 can be positioned between rods 626, thereby preventing rods 626 from moving towards each other and disengaging from linkage arms 610 and 611. Specifically, tab 900 extends laterally between a first side surface 901 and a second side surface 902, which are respectively positioned to abut each rod 626. Tab 900 can be attached to upper head housing 406 (FIG. 19) so as to protrude downward from the inner surface thereof.

Figure 37:
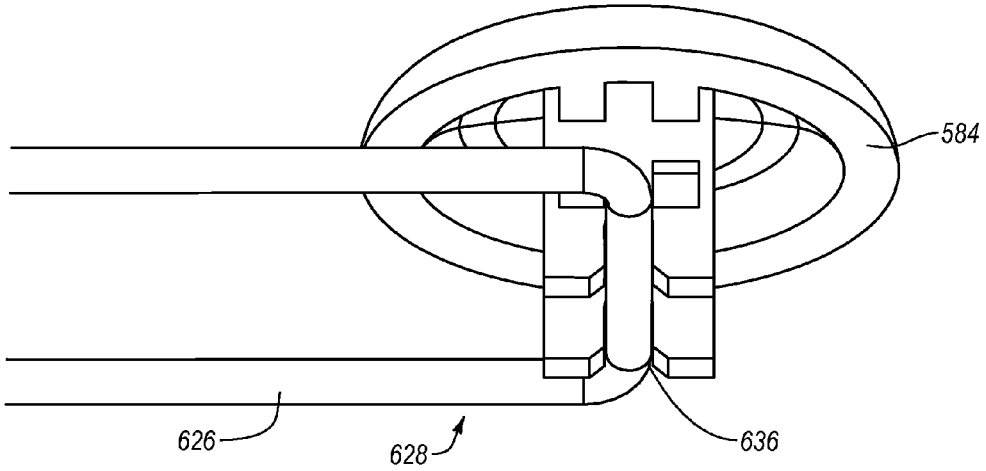
FIGS. 37 and 38 are perspective views of various embodiments of an actuator.

To allow the user to cause the linkage arms 610 to move longitudinally, actuator 584 is attached to linkage rods 626 at the proximal end 628 thereof. For example, as depicted in FIG. 31, actuator 584 can take the form of a button disposed on upper head housing 406. Turning to FIG. 37, button 584 has formed therein channels 636 that are sized so as to receive the proximal ends 628 of linkage rods 626, or, as in the depicted embodiment, the single end of linkage rod 626 if only a single rod is used.

Figure 38:
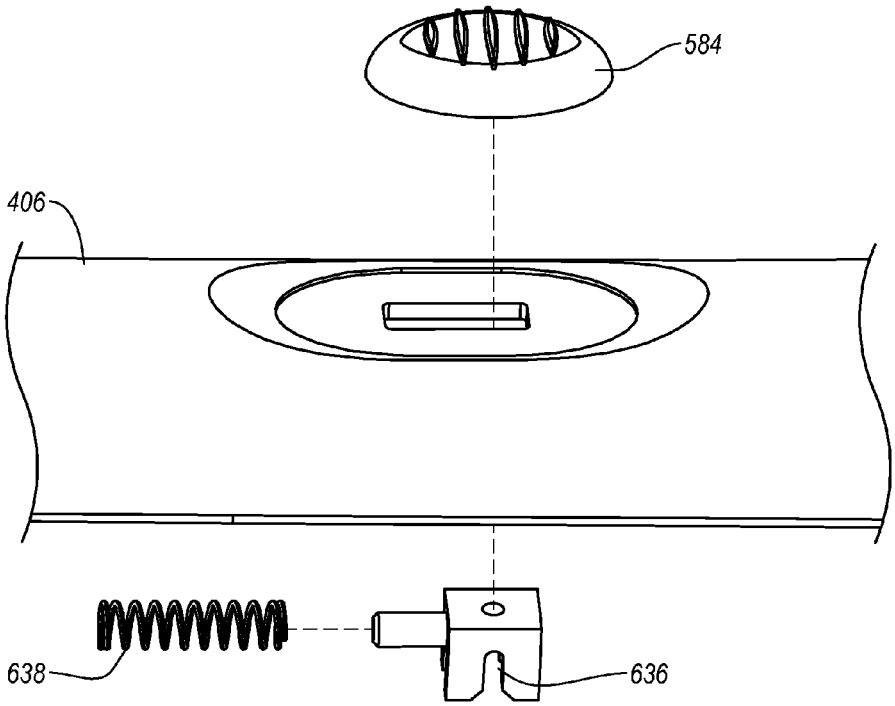

As shown in FIG. 38, a spring 638 can also be used, as is known in the art, to cause button 584 to remain in a set position until the button is moved. Once the button 584 is released, the button 584 goes back to the set position by virtue of the force caused by the spring 638. Spring 638 is attached to upper head housing 406 so as to provide the force on button 584.

Figure 39:
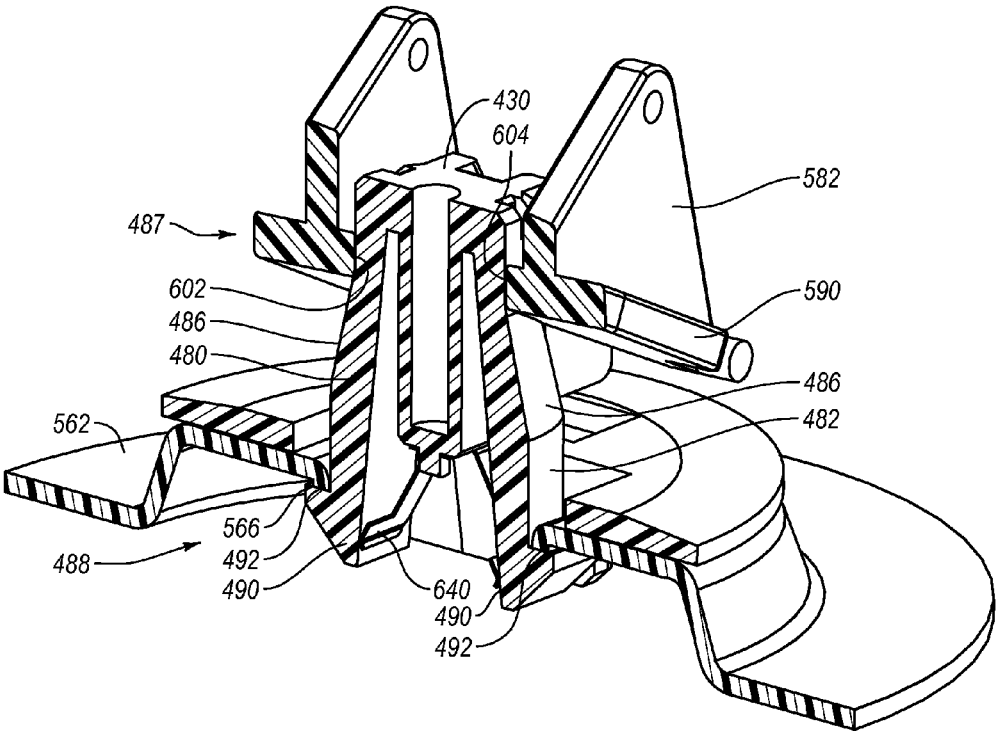
FIG. 39 is a cross sectional side view of a hub, carrier plate, and disengaging member in a first position wherein carrier plate is secured to the hub.

During normal use, cleaning head 560 is rigidly secured to hub 430, as shown in FIG. 30. During this attached position, disengaging member 582 is pivoted up, as shown in FIGS. 35 and 39. As shown in FIG. 39, when disengaging member 582 is in the attached position, the inner side surfaces 602 and 604 of main body 590 contact the outer surface 486 of arms 480 and 482 at the proximal end 487 thereof. As a result, the lips 492 of barbs 490 on distal end 488 of arms 480 and 482 overlap bottom surface 566 of carrier plate 562, and if used, catches 854 are locked into grooves 855, thereby rigidly securing cleaning head 562 to hub 430. In this attached position, linkage rods 626 and button 584 are in their most proximal positions. A leaf spring 640 can be used to provide a separating force between arms 480 and 482 at distal end 488 so as to keep arms 480 and 482 separated when no other force is applied thereto.

Figure 40:
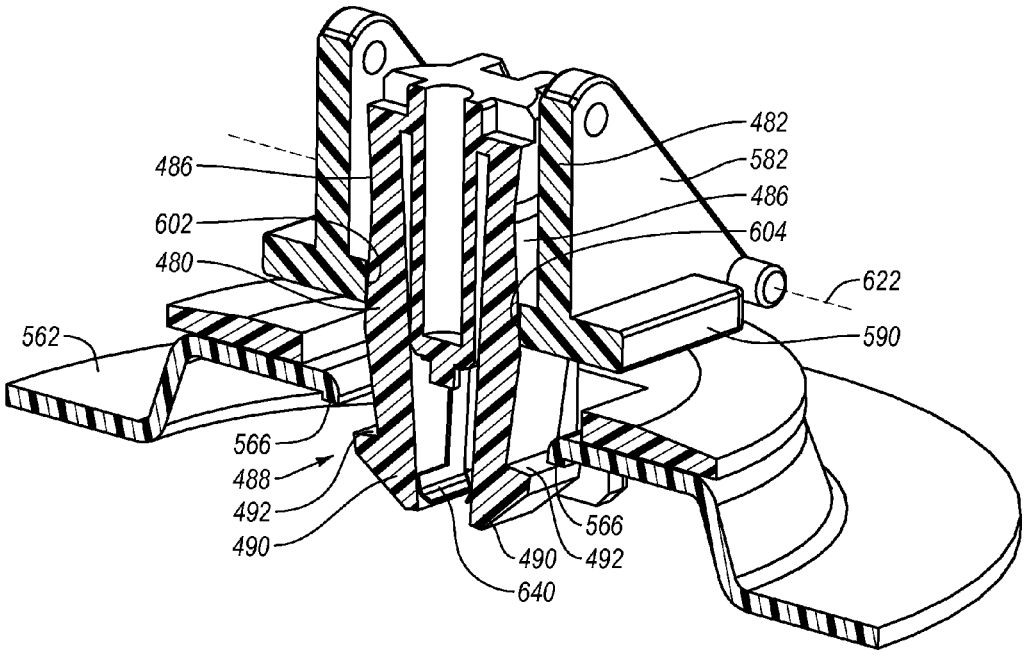
FIG. 40 is a cross sectional side view of the hub, carrier plate, and disengaging member shown in FIG. 3 in a second position wherein carrier plate can be removed from the hub.

As noted above, to remove or attach cleaning head 560 to head assembly 402, arms 480 and 482 of hub 430 must be forced towards each other until barbs 490 do not overlap with the inner side surface bounding aperture 572. This is done by pivoting disengaging member 582 down to the detaching position shown in FIG. 40. To pivot disengaging member 582 to the detaching position, button 584 is pushed distally, causing linkage rods 626 to move distally, thereby pivoting disengaging member 582 about rotational axis 622. As disengaging member 582 is pivoted downward, the inner side surfaces 602 and 604 of main body 590 move toward the distal ends 488 of arms 480 and 482. Because the outer surfaces 486 of arms 480 and 482 flair outward as one moves towards the distal end 488, inner side surfaces 602 and 604 of main body 590 push inward on arms 480 and 482, and cause the arms 480 and 482 to be pushed towards each other, overcoming the force of leaf spring 640. This continues until disengaging member 582 arrives at the detaching position shown in FIG. 40. At this position, barbs 490 on distal end 488 of arms 480 and 482 have been moved inward such that lips 492 are not overlapping bottom surface 566 of carrier plate 562. Cleaning head 560 can then be detached from hub 430 and a replacement cleaning head can be attached in its place.

In light of the above discussion, disengaging system 580 is movable between a first position where cleaning head 560 is securely engaged to hub 430 and a second position where cleaning head 560 is freely removable from hub 430. Furthermore, disengaging system 580 is movable between the first and second positions by actuator 584 which is disposed on a portion of the housing that is remote from the hub 430.

Because arms 480 and 482 together form arcs of a circle, the cleaning head 560 can be removed from hub 430 even when in use. That is, even when hub 430 and cleaning head 560 are reciprocally rotating, disengaging member 582 can be pivoted to the disengaging position and the cleaning head 560 can be removed without causing any damage to the cleaning apparatus 400.

An exemplary method of cleaning that can be performed with embodiments of the cleaning apparatus disclosed herein can include: attaching a cleaning head to a distal end of a cleaning apparatus; activating a first actuator to rotate the cleaning head; deactivating the actuator to stop rotation of the cleaning head; and activating a second actuator located at a proximal end of the cleaning apparatus to remotely disengage the cleaning head from the cleaning apparatus. In some embodiments, the first actuator can be located at the proximal end of the cleaning apparatus. If desired, the method can further include cleaning a toilet after activating the first actuator. Either of the first or second actuators can be a switch, a button, or any other type of actuator known by one skilled in the art. In some embodiments, activating the second actuator forces a pair of arms disposed on a hub toward each other so as to cause a barb on each arm to become disengaged with the cleaning head, as discussed previously. Also as discussed previously, the pair of arms can be forced toward each other by pivoting a disengaging member from an attaching position to a detaching position.

Figure 41:
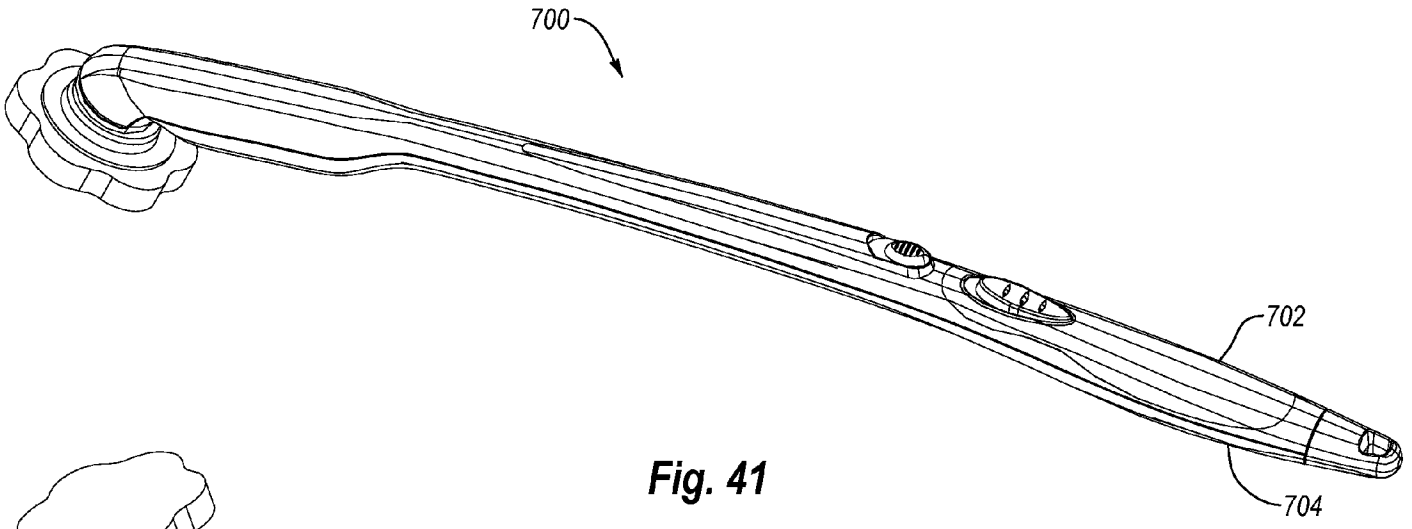
FIGS. 41 and 42 are perspective views of another alternative embodiment of a cleaning apparatus according to the present invention.
Figure 42:
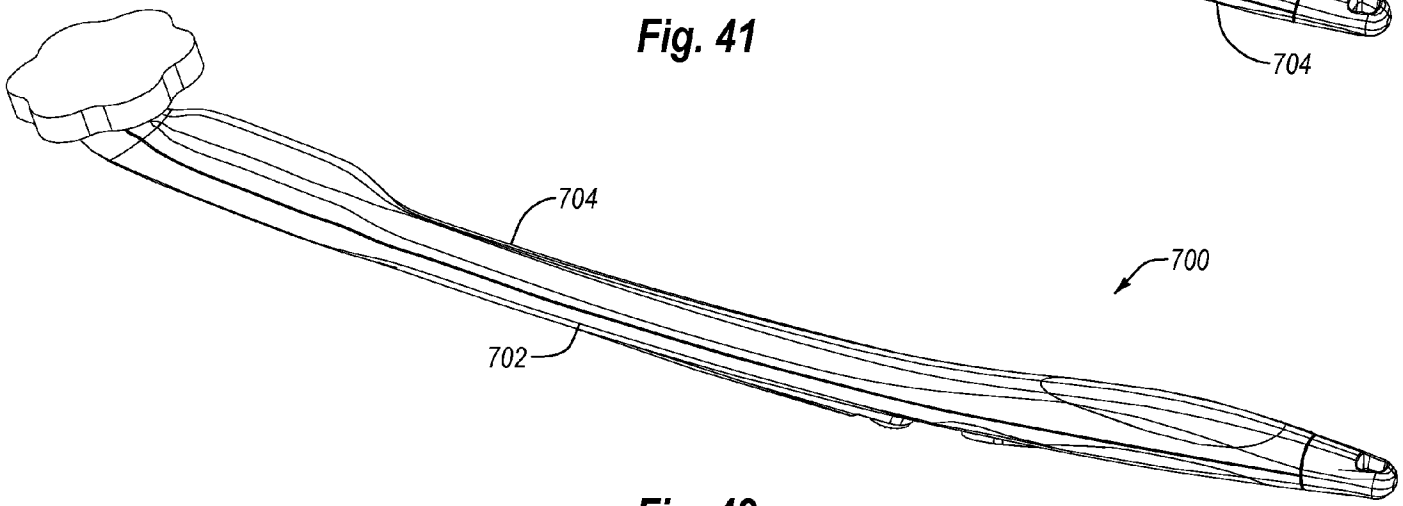

Depicted in FIGS. 41 and 42 is an alternative embodiment of a cleaning apparatus 700 incorporating features of the present invention. Like elements between cleaning apparatus 700 and the embodiments discussed previously herein are identified by like reference characters. Cleaning apparatus 700 is similar to cleaning apparatus 400, except that instead of having separate body and head assemblies 206 and 402, cleaning apparatus 700 has combined them into a single body assembly 702.

Figure 43:
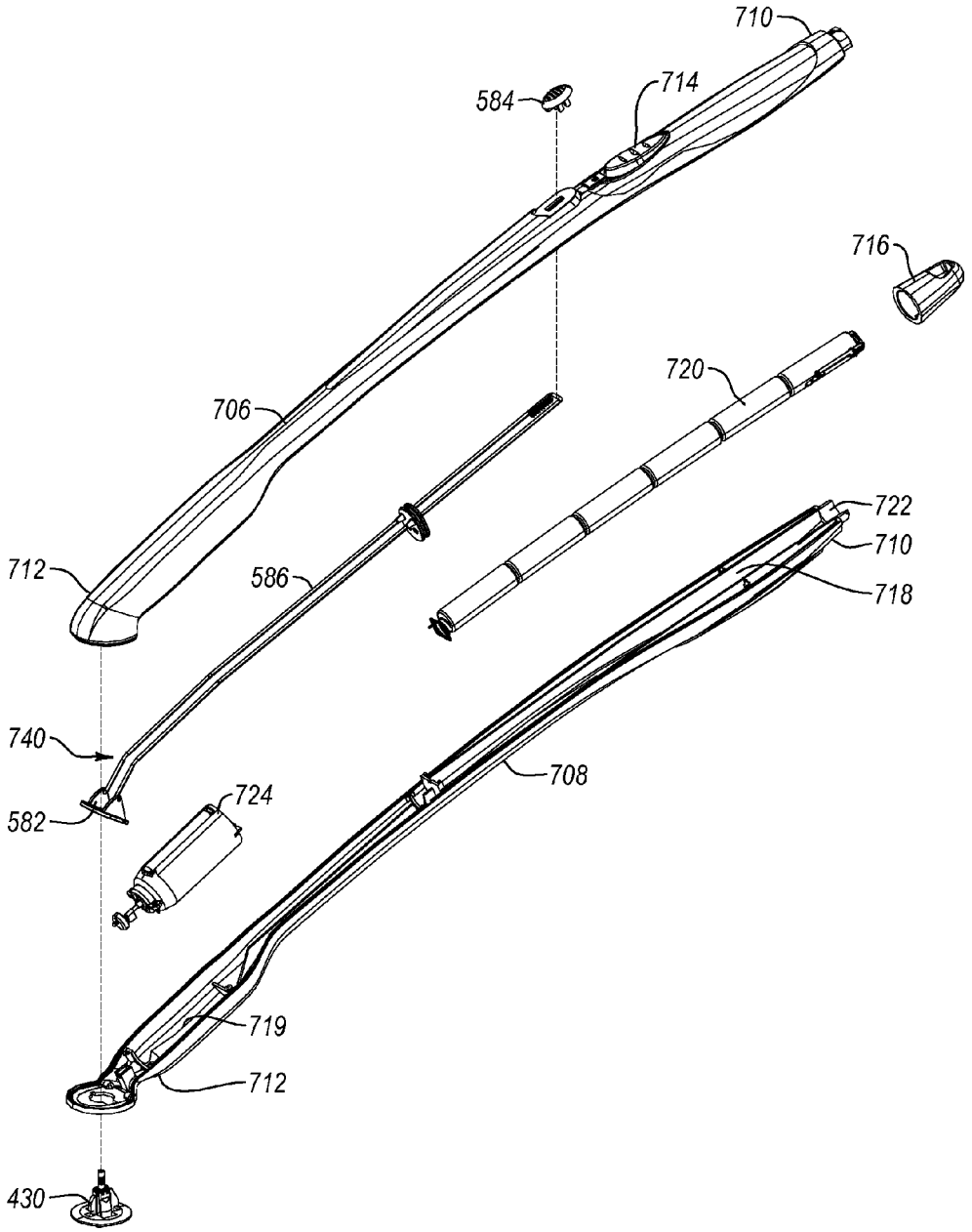
FIG. 43 is an exploded perspective view of the cleaning apparatus shown in FIGS. 41 and 42, without the cleaning head.

As such, body assembly 702 includes a body housing 704 having a substantially cylindrical configuration. Turning to FIG. 43, body housing 704 comprises an upper body housing 706 which mates with a lower body housing 708. Each of body housings 706 and 708 each extend from a proximal end 710 to an opposing distal end 712.

Similar to other embodiments discussed herein, upper body housing 706 has a flexible button 714 that is used to turn the device on and off. Button 714 is used in a similar manner to buttons discussed previously.

Also similar to other embodiments discussed herein, body housing 704 bounds a battery compartment 718 and a motor compartment 719 respectively disposed at proximal end 710 and distal end 712 of body housing 704. Battery compartment 718 is configured to receive a plurality of batteries. For example, in the depicted embodiment, battery compartment 718 is configured to receive six batteries 720 of a size AA aligned end to end. Other configurations can also be used, as discussed previously. Battery compartment 718 is accessed through an opening 722 formed at proximal end 710 of body housing 704. Similar to other embodiments discussed herein, opening 722 is selectively closed by an end cap 716, which is removably mounted to proximal end 710 of body housing 704. End cap 716 is similar to end cap 30, except that end cap 716 is configured to be used with a battery compartment that holds batteries in-line. As discussed above, an annular seal ring can be used to form a liquid tight seal between body housing 704 and end cap 716, if desired.

Figure 52A:
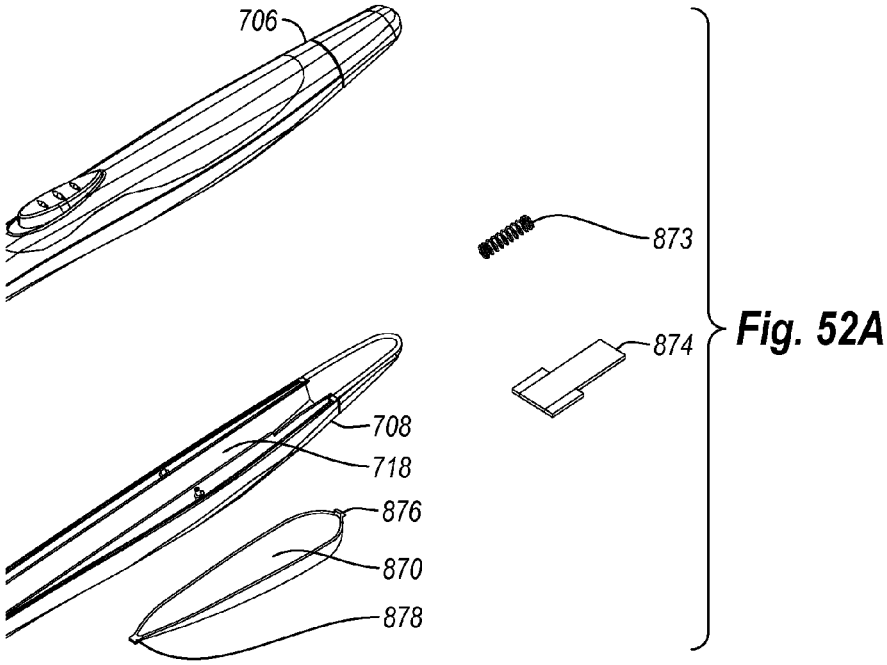
FIGS. 52A-C are various views of an alternative battery compartment arrangement.
Figure 52B:
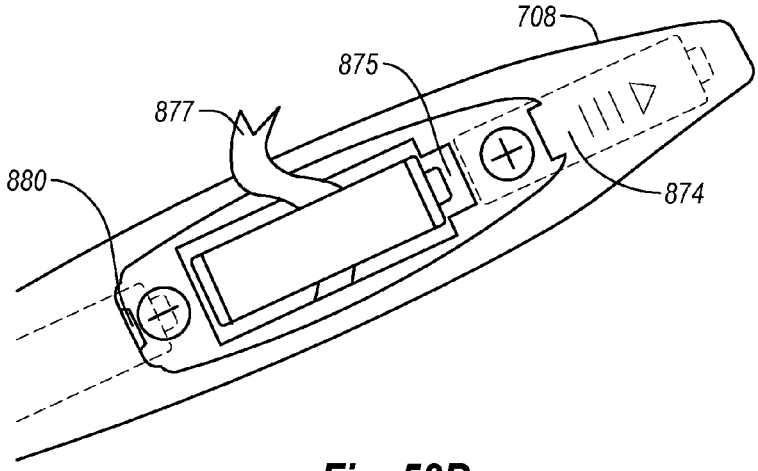
Figure 52C:
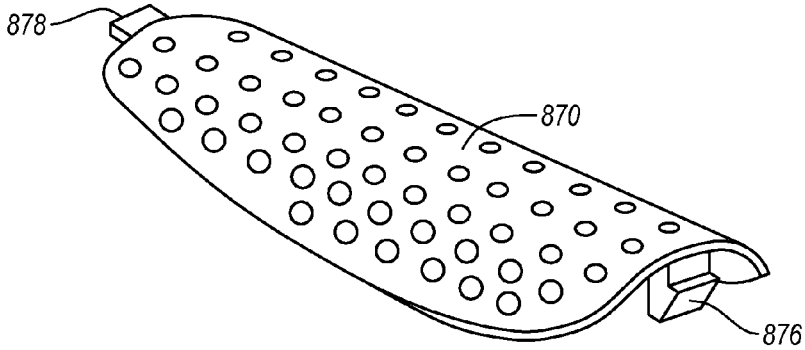

An alternative battery compartment arrangement is shown in FIGS. 52A-52C that would eliminate opening 722 and end cap 716. In this arrangement, body housings 706 and 708 can be molded to respectively include the upper and lower portions of end cap 716. A lower grip and battery cover 870 would cover a battery opening 875 and would be held in place by a slide 874 that can be spring loaded using spring 873.

To change the batteries, slide 874 can be slid longitudinally toward the proximal end of the brush, causing the distal end of slide 874 to release a barb 876 formed on battery cover 870. This, in turn, can allow the lower grip and battery cover 870 to open. As is known in the art, a cloth tab 877 can be pulled upward to disengage and remove batteries 720. New batteries can then be inserted into the battery compartment and battery cover 870 secured by inserting a tab 878 into a corresponding receiving slot 880 and sliding slide 874 (or allowing it to slide by virtue of the spring loading) over barb 876.

Similar to previous embodiments, cleaning apparatus 700 includes a motor assembly 724 mounted within motor compartment 719. As noted above and shown in the depicted embodiment, motor compartment 719 is disposed at distal end 712 of body housing 704. As such, motor assembly 724 is disposed adjacent to hub 430, and can do without many of the linkages used with previously discussed embodiments. Furthermore, no mechanism is required to selectively uncouple any drive shafts from the motor assembly 724 since there is no removable head assembly.

Figure 44:
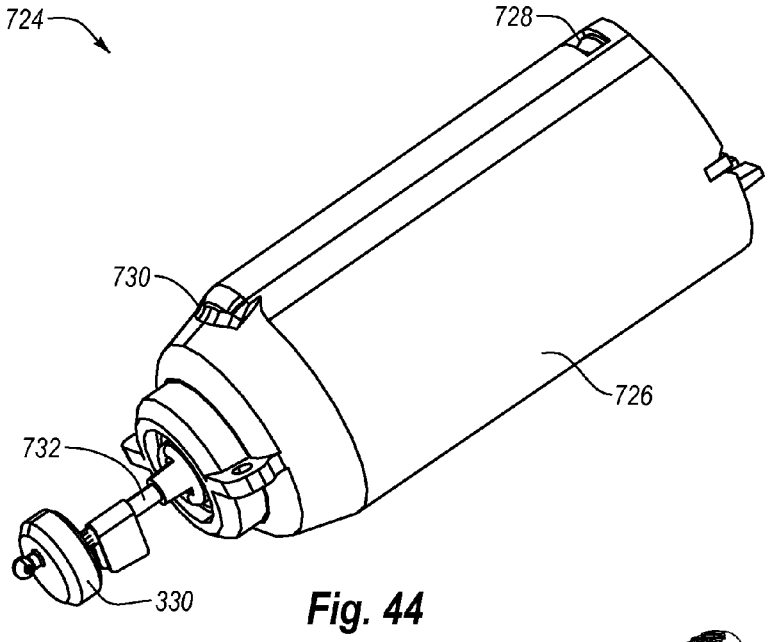
FIG. 44 is a perspective view of the motor assembly shown in FIG. 43.

Turning to FIG. 44, motor assembly 724 comprises a motor 726 having a proximal end 728 and an opposing distal end 730. Projecting from distal end 730 of motor 726 is a drive shaft 732. Because of the proximity of motor assembly 724 to hub 430 (see FIG. 43), enlarged disk 330 is directly secured to drive shaft 732. Enlarged disk 330 is connected to hub 430 and used in a similar manner to that discussed with respect to cleaning apparatus 400.

Figure 45:
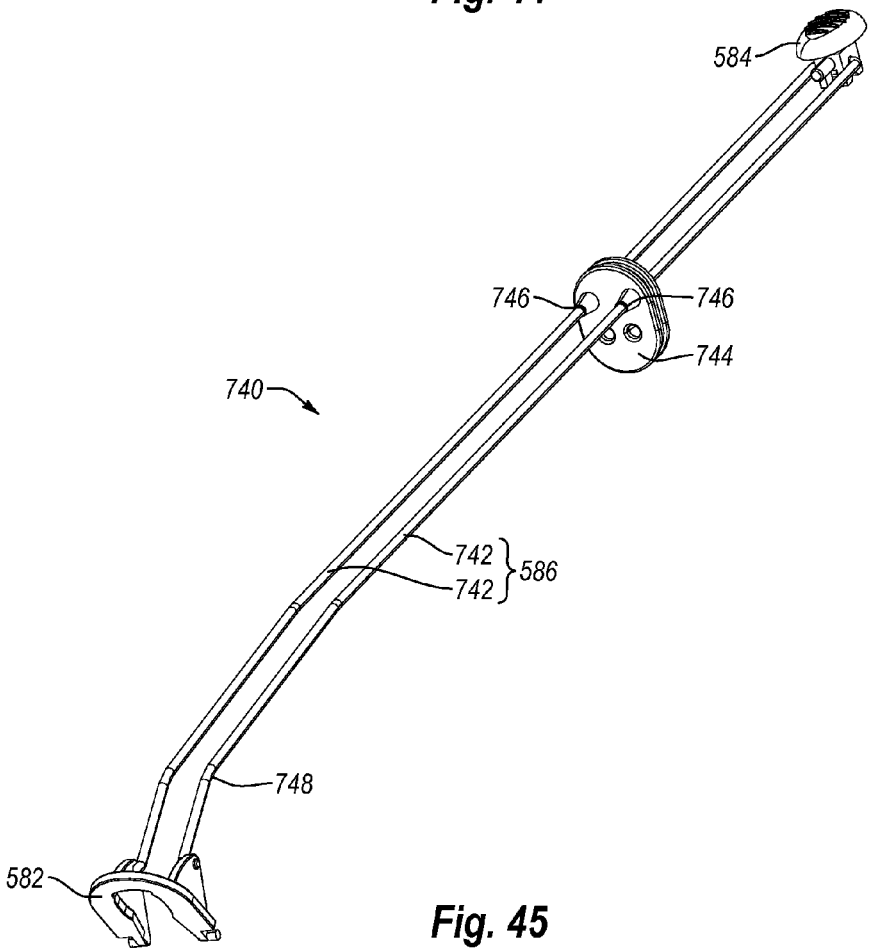
FIG. 45 is a side perspective view of the disengaging system shown in FIG. 43.

Returning to FIG. 43, cleaning apparatus 700 also includes a disengaging system 740 to facilitate the attachment and removal of cleaning head 560. Turning to FIG. 45, similar to disengaging system 580 of cleaning apparatus 400, disengaging system 740 comprises disengaging member 582, actuator 584, and linkage 586 between actuator 584 and disengaging member 582. Disengaging system 740 is similar to disengaging system 580 except for a few things. For example, instead of substantially straight linkage rods 626, linkage rods 742 of disengaging system 580 have one or more bends 748 so as to navigate around motor 726. Also, unlike disengaging system 580, disengaging system 740 includes a positioning member 744 that has a pair of apertures 746 extending therethrough. Positioning member 744 is mounted to body housing 704 and linkage rods 742 are passed through apertures 746. Positioning member 744 helps keep linkage rods 742 positioned securely within body housing 704, yet allows linkage rods 742 to move back and forth through apertures 746. Positioning member 744 can also serve as a seal, e.g., a watertight seal, to prevent water or other external matter from entering into battery compartment 718 (FIG. 43).

Returning to FIGS. 41 and 42, cleaning apparatus 700 also includes a cleaning head similar to cleaning apparatus 400. As discussed above, cleaning head 560 is rigidly secured to hub 430 and reciprocally moves therewith.

Figure 46:
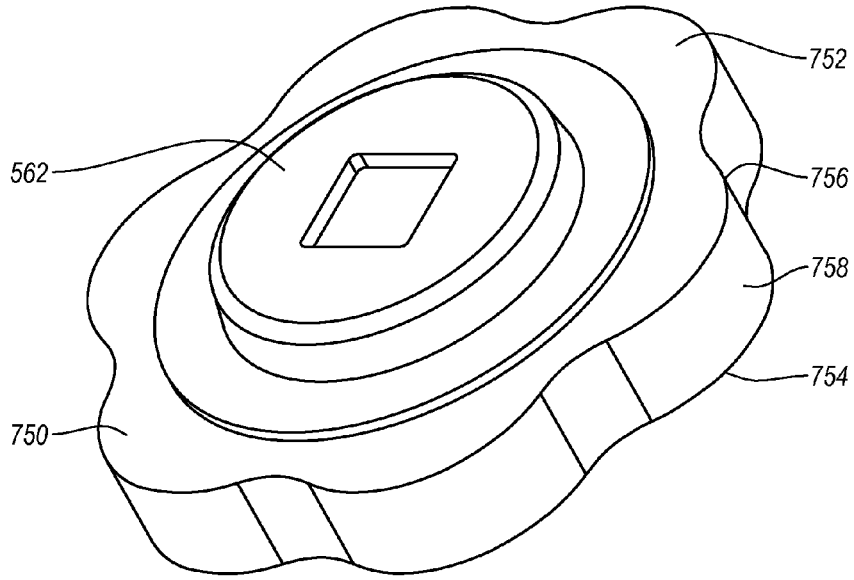
FIG. 46 is a perspective view of a cleaning head having an alternative cleaning pad.

Turning to FIG. 46, an alternative embodiment of a cleaning pad 750 is shown. Similar to cleaning pad 576, cleaning pad 750 has a top surface 752 which attaches to carrier plate 562, and an opposing bottom surface 754. Top and bottom surfaces 752 and 754 each radially extend to an outer edge 756, with a perimeter sidewall 758 extending between top and bottom surfaces 752 and 754. However, instead of being substantially circular, cleaning pad 750 is in the shape of a floret. That is, outer edge 756 of top and bottom surfaces 752 and 754 is shaped so as to undulate as outer edge 756 encircles top and bottom surfaces 752 and 754. By doing so, a plurality of lobes 760 are formed.

Figure 47:
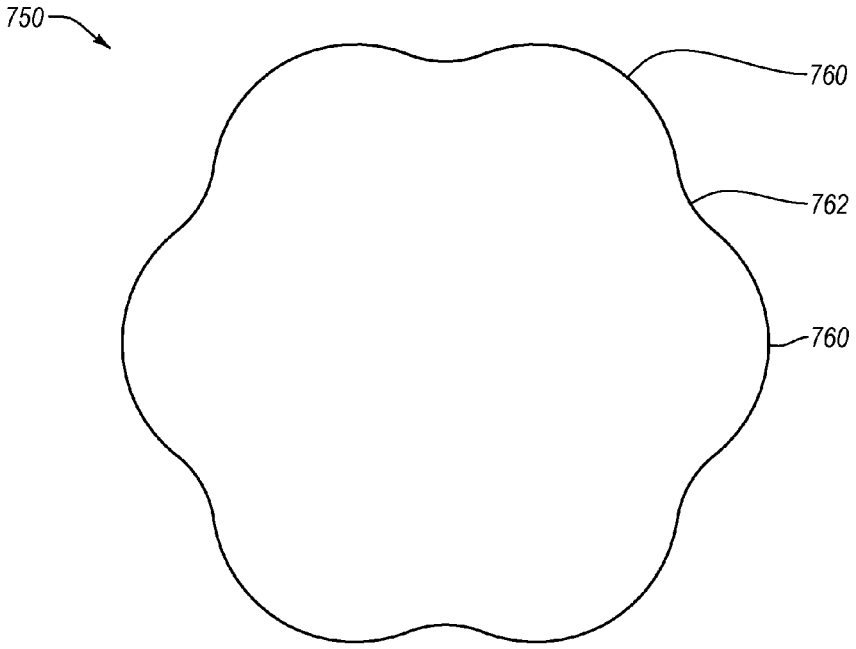
FIG. 47 is a bottom plan view of the cleaning pad shown in FIG. 46.

For example, as shown in FIG. 47, cleaning pad 750 includes six lobes 760 evenly spaced around outer edge 756. Each lobe 760 has a smooth convex shape and is separated from the next adjacent lobe by a smooth concave transition 762.

Using a floret shaped pad gives unique and significant advantages over circular pads when using an edge-on force. For example, when a rapidly rotating circular pad is pushed edge-on against a surface, the edge of the pad exerts a constant force at a constant tangential angle to the surface. As such, the pad is simply "pushing" against the surface. In contrast, when a rapidly rotating floret shaped pad is used, the angle formed between the edge of the pad and the surface constantly changes as each lobe passes over the surface because of the shape of the lobe. As a result, the pad hits the surface at constantly changing angles, which results in a chiseling type of action, which improves the cleaning action. This can be a great benefit when cleaning the bowl of a toilet, for example.

FIG. 47 is but one example of a floret pattern that can be used with the present invention. The cleaning pad can come in different thicknesses and sizes, with different numbers of lobes, and with lobes of different configurations. It is appreciated that the selection of these different configurations can be based on desired ornamental properties.

Figure 48:
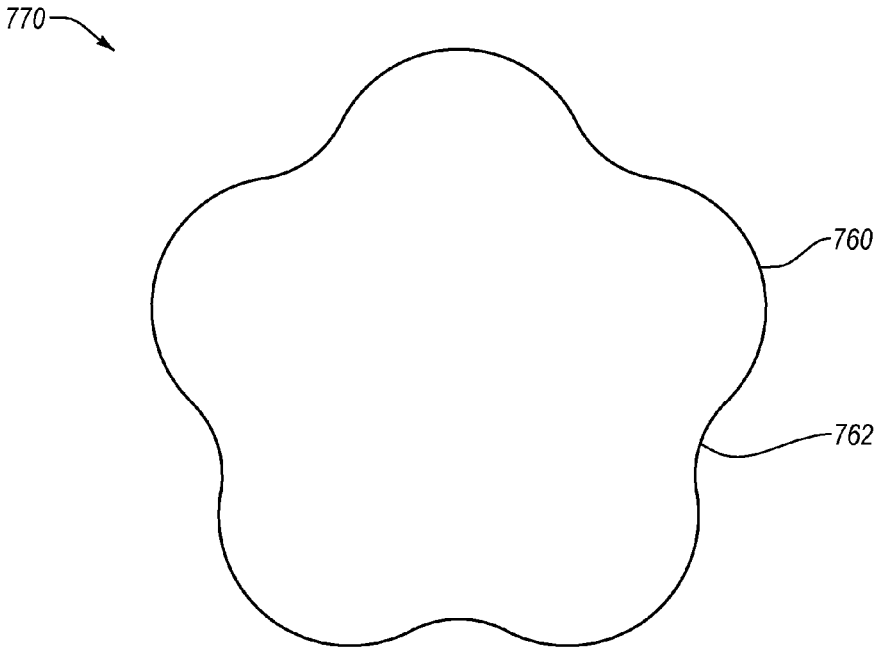
FIGS. 48 and 49 are bottom plan views of alternative embodiments of cleaning pads.

FIG. 48 shows an alternative embodiment of a cleaning pad 770 in which five lobes 760 are used. In other embodiments, seven lobes can be used. More than seven lobes or less than five lobes can alternatively be used.

Figure 49:
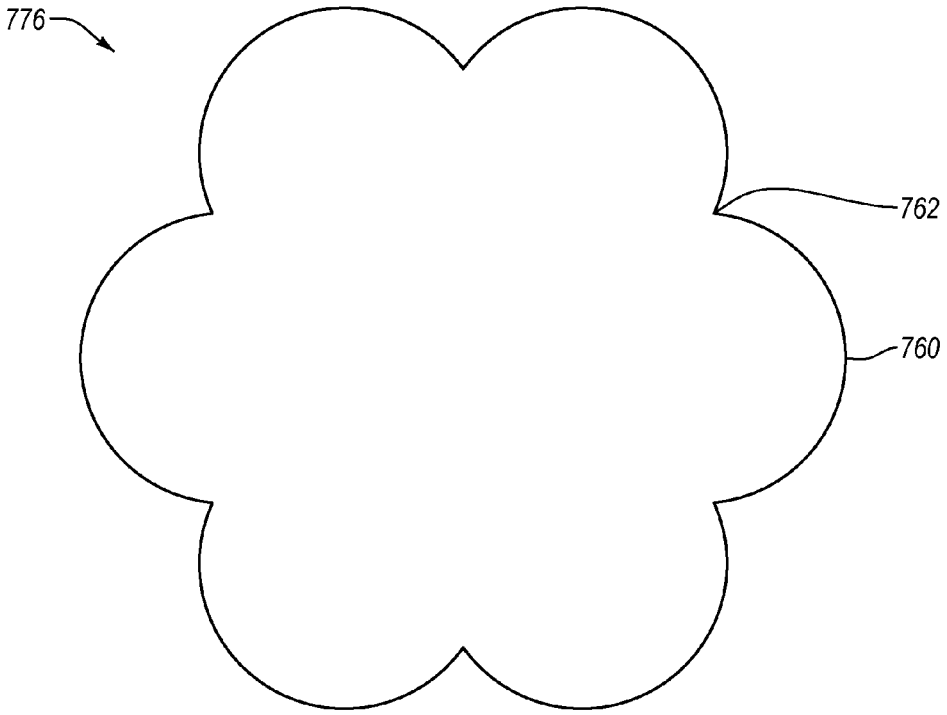

Although lobes and transitions are shown as being smoothly curved, this is not required. For example, FIG. 49 shows an alternative embodiment of a cleaning pad 776 in which the transitions 762 are abrupt, forming substantially v-shaped valleys between lobes 760. In other embodiments, lobes 760 can come to a point instead of being smoothly curved. In some embodiments, both lobes and transitions can be non-smooth so as to form a saw-tooth sort of pattern. Other shapes can alternatively be used.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A cleaning apparatus comprising:

an elongated housing having a chamber;

a motor at least partially disposed within the chamber;

a drive shaft at least partially disposed within the chamber, the drive shaft being coupled with the motor such that during selective operation of the motor, the drive shaft is rotated about a rotational axis thereof;

a hub having a rotational axis about which the hub rotates, the hub being coupled with the drive shaft such that rotation of the drive shaft facilitates rotation of the hub;

a cleaning head comprising a carrier plate, the cleaning head removably coupled with the hub such that rotation of the hub causes rotation of the carrier plate, the cleaning head further comprising a scrubbing element secured to the carrier plate;

the hub further comprising:

a base having a top surface and a bottom surface, with opposing side surfaces extending between the top and bottom surfaces;

a pair of resilient arms, each extending downward from the top surface along opposing side surfaces so as to form a gap between each arm and its corresponding side surface; each resilient arm having a distal end that extends beyond the bottom surface of the base; and an engaging member disposed at the distal end of each arm, the arms being movable between a first position in which the engaging member engages with the carrier plate and a second position in which the engaging member is disengaged from the carrier plate; and a disengaging system movable between a first position where the cleaning head is securely engaged to the hub and a second position where the cleaning head is freely removable from the hub.

2. The cleaning apparatus as recited in claim 1, wherein the disengaging system is disposed within the housing.

3. The cleaning apparatus as recited in claim 2, wherein the disengaging system is movable between the first and second positions by an actuator disposed on a portion of the housing that is remote from the hub.

4. The cleaning apparatus as recited in claim 1, wherein the cleaning head is removable from the hub during rotation of the hub and cleaning head.

5. The cleaning apparatus as recited in claim 1, wherein the disengaging system comprises:

a disengaging member configured to release the cleaning head from the hub;

an actuator; and a linkage coupling the actuator to the disengaging member.

6. The cleaning apparatus as recited in claim 5, wherein the housing extends between a first end and a second end, the hub being disposed at the second end of the housing, the disengaging member being disposed adjacent the hub.

7. The cleaning apparatus as recited in claim 5, wherein the linkage comprises a proximal end and a distal end, and wherein an actuator is attached to the proximal end of the linkage and the disengaging member is attached to the distal end of the linkage.

8. The cleaning apparatus as recited in claim 1, wherein each engaging member comprises a barb having a lip, each lip catching on a surface of the carrier plate when the arms are in the first position.

9. The cleaning apparatus as recited in claim 8, wherein each lip includes a catch formed thereon configured to be received within a groove formed on the carrier plate.

10. The cleaning apparatus as recited in claim 1, wherein the scrubbing element comprises a cleaning pad comprised of a non-woven nylon or polyester mesh material.

11. The cleaning apparatus as recited in claim 10, wherein the cleaning pad is impregnated with a cleaning solution.

12. The cleaning apparatus as recited in claim 10, wherein the cleaning pad comprises a plurality of spaced lobes.

13. The cleaning apparatus as recited in claim 1, wherein the disengaging system comprises a disengaging member that squeezes the distal ends of the arms toward each other to move the arms from the first position to the second position.

14. The cleaning apparatus as recited in claim 13, wherein the disengaging member pivots to squeeze the arms toward each other.

15. The cleaning apparatus as recited in claim 1, wherein the cleaning head has a rotational axis about which the cleaning head rotates, and wherein the rotational axis of the cleaning head intersects the rotational axis of the drive shaft so as to form an inside angle greater than 95°.

16. A cleaning apparatus comprising:

a body assembly comprising:

an elongated body housing having a chamber;

a motor at least partially disposed within the chamber of the body housing; and a body drive shaft at least partially disposed within the chamber of the body housing, the body drive shaft being coupled with the motor such that during selective operation of the motor, the body drive shaft is rotated about a rotational axis thereof;

a head assembly removably coupled with the body assembly, the head assembly comprising:

a head housing;

a head drive shaft disposed within the head housing and having a rotational axis about which the head drive shaft rotates; and a hub having a rotational axis about which the hub rotates, the hub being coupled with the head drive shaft such that rotation of the head drive shaft facilitates rotation of the hub;

a cleaning head comprising a carrier plate, the cleaning head removably coupled with the hub such that rotation of the hub causes rotation of the carrier plate, the cleaning head further comprising a scrubbing element secured to the carrier plate;

the hub further comprising:

a base having a top surface and a bottom surface, with opposing side surfaces extending between the top and bottom surfaces;

a pair of resilient arms, each extending downward from the top surface along opposing side surfaces so as to form a gap between each arm and its corresponding side surface; each resilient arm having a distal end that extends beyond the bottom surface of the base; and an engaging member disposed at the distal end of each arm, the arms being movable between a first position in which the engaging member engages with the carrier plate and a second position in which the engaging member is disengaged from the carrier plate; and a disengaging system movable between a first position where the cleaning head is securely engaged to the hub and a second position where the cleaning head is freely removable from the hub.

17. A method of cleaning, comprising:

attaching a cleaning head to a distal end of a cleaning apparatus, the cleaning apparatus comprising:

an elongated housing having a chamber;

a motor at least partially disposed within the chamber;

a drive shaft at least partially disposed within the chamber, the drive shaft being coupled with the motor such that during selective operation of the motor, the drive shaft is rotated about a rotational axis thereof;

a hub having a rotational axis about which the hub rotates, the hub being coupled with the drive shaft such that rotation of the drive shaft facilitates rotation of the hub;

a cleaning head comprising a carrier plate, the cleaning head removably coupled with the hub such that rotation of the hub causes rotation of the carrier plate, the cleaning head further comprising a scrubbing element secured to the carrier plate;

the hub further comprising:

a base having a top surface and a bottom surface, with opposing side surfaces extending between the top and bottom surfaces;

a pair of resilient arms, each extending downward from the top surface along opposing side surfaces so as to form a gap between each arm and its corresponding side surface; each resilient arm having a distal end that extends beyond the bottom surface of the base; and an engaging member disposed at the distal end of each arm, the arms being movable between a first position in which the engaging member engages with the carrier plate and a second position in which the engaging member is disengaged from the carrier plate; and a disengaging system movable between a first position where the cleaning head is securely engaged to the hub and a second position where the cleaning head is freely removable from the hub;

activating a first actuator to rotate the cleaning head;

deactivating the first actuator to stop rotation of the cleaning head; and activating a second actuator to remotely disengage the cleaning head from the cleaning apparatus.

18. The method as recited in claim 17, wherein activating the second actuator forces a pair of arms disposed on a hub toward each other so as to cause a barb on each arm to become disengaged with the cleaning head by pivoting a disengaging member from an attaching position to a detaching position.

* * * * *